US005999760A

United States Patent [19]

Suzuki et al.

[11] Patent Number: 5,999,760

[45] Date of Patent: Dec. 7, 1999

[54] CONTROL METHOD AND IMAGE FORMING APPARATUS

[75] Inventors: Takehiko Suzuki, Numazu; Toshiaki Miyashiro, Shizuoka-ken, both of Japan

[73] Assignee: Canon Kabushiki Kaisha, Tokyo, Japan

[21] Appl. No.: 09/032,028

[22] Filed: Feb. 27, 1998

[30] Foreign Application Priority Data

| | | | |
|---|---|---|---|
| Feb. 28, 1997 | [JP] | Japan | 9-046715 |
| May 29, 1997 | [JP] | Japan | 9-155771 |
| Feb. 24, 1998 | [JP] | Japan | 10-042044 |

[51] Int. Cl.[6] ..... G03G 15/00; G03G 15/16

[52] U.S. Cl. ..... 399/45; 399/50; 399/66

[58] Field of Search ..... 399/66, 53, 55, 399/50, 44, 45

[56] References Cited

U.S. PATENT DOCUMENTS

| | | | |
|---|---|---|---|
| 4,772,918 | 9/1988 | Karasawa et al. | 399/66 |
| 5,214,480 | 5/1993 | Aoki et al. . | |
| 5,249,023 | 9/1993 | Miyashiro et al. . | |
| 5,287,144 | 2/1994 | Takeda | 399/66 |
| 5,287,163 | 2/1994 | Miyashiro . | |
| 5,348,283 | 9/1994 | Yanagi et al. . | |
| 5,370,380 | 12/1994 | Suzuki et al. . | |
| 5,390,012 | 2/1995 | Miyashiro et al. . | |
| 5,491,536 | 2/1996 | Mashiba et al. | 399/59 |
| 5,508,796 | 4/1996 | Sasame et al. . | |
| 5,523,829 | 6/1996 | Miyashiro et al. . | |
| 5,530,522 | 6/1996 | Tsunemi | 399/66 |
| 5,539,507 | 7/1996 | Miyashiro et al. . | |
| 5,543,904 | 8/1996 | Kato et al. . | |
| 5,580,042 | 12/1996 | Taniguro et al. . | |
| 5,592,280 | 1/1997 | Ishizuka et al. . | |
| 5,620,174 | 4/1997 | Taniguro et al. . | |
| 5,648,808 | 7/1997 | Yanagi et al. . | |
| 5,672,019 | 9/1997 | Hiramatsu et al. . | |
| 5,725,319 | 3/1998 | Saito et al. . | |

FOREIGN PATENT DOCUMENTS

| | | |
|---|---|---|
| 5-313516 | 11/1993 | Japan . |
| 6-035344 | 2/1994 | Japan . |
| 7-230223 | 8/1995 | Japan . |
| 9-080924 | 3/1997 | Japan . |

*Primary Examiner*—Matthew S. Smith

*Attorney, Agent, or Firm*—Fitzpatrick, Cella, Harper & Scinto

[57] ABSTRACT

The present invention provides a control method for controlling of output of a constant voltage power source so that a current value detected by a current detect means becomes to a predetermined current value, by applying voltage from the constant voltage power source to a voltage applied member and by detecting current flowing the voltage applied member by the current detect means and by changing the voltage applied to the voltage applied member every certain voltage width, wherein the voltage width can be varied with a difference between the predetermined current value and the current value detected by the current detect means.

117 Claims, 21 Drawing Sheets

CONTROL METHOD AND IMAGE FORMING APPARATUS

BACKGROUND OF THE INVENTION

1. Field of the Invention

The present invention relates to a constant-current control method for a constant voltage source and the like, and an electrophotographic image forming apparatus such as a printer or a copying machine using such a constant-current control method.

2. Related Background Art

First of all, an example of a conventional constant-current control method in which a constant voltage source is used and the constant voltage source is controlled by a CPU so that detected current becomes a target current value will be explained with reference to FIG. 19. In this method, since the control is effected by the CPU with simple arrangement, control including both constant voltage and constant current can be effected, and a constant voltage value and a constant current value can freely be set so that fine control can be permitted. Thus, this method is suitable for an image forming apparatus and is particularly applied to high voltage control for an electrophotographic image forming apparatus.

A matter 200 to which voltage is applied (referred to as "voltage applied matter" hereinafter) is connected to a constant voltage power source 210 and a current detect means 220 for detecting flowing current, and the power source 210 and the detect means 220 are connected to a CPU (control means) 230. When the voltage is applied from the constant voltage power source 210 to the voltage applied matter 200, a detection signal from the current detect means 220 is inputted to the CPU 230, and, on the basis of the inputted signal, the CPU 230 controls the constant voltage power source 210 so that the current becomes a predetermined current value.

The voltage applied matter 200 may, for example, be a first charge means, a developing means, a transfer means, a transfer material absorbing means or an electricity removing means of an electrophotographic image forming apparatus.

Next, the above control method will be fully described with reference to a flow chart shown in FIG. 20.

When the constant-current control is started to apply the voltage V to the voltage applied body 200 (step 1), a value of the current generated by the apply voltage is detected by the current detect means 220 and then is converted into an analogue signal of 5V which is in turn inputted to the CPU 230. The detection signal inputted to the CPU 230 is A/D-converted into 8-bit value (step 2).

A current value i obtained in this way is compared with a target current value i0 in the CPU 230 (step 3). If a difference (target current value−present current value) is positive (plus), a voltage value obtained by adding a predetermined voltage change width ΔV to the present voltage value V is set (step 4), and, if the difference is zero, the present voltage value V is set as it is (step 5), and, if the difference is negative (minus), a voltage value obtained by subtracting a predetermined voltage change width ΔV from the present voltage value V is set (step 6). After it is judged whether the control is finished or not (step 7), if negative, the constant voltage power source 210 applies the voltage V to the voltage applied matter 200 in accordance with the voltage value outputted from the CPU 230 (step 8). By repeating this operation, the current is converged to the target current value, thereby achieving the constant current control.

FIG. 22 schematically shows a photosensitive drum (image bearing member) 111 and a transfer device 115 of a full-color image forming apparatus using the above-mentioned conventional constant current control. Incidentally, in FIG. 22, process means for forming an image such as a charge device, an exposure device, a developing device (with yellow, cyan, magenta and black toners) and a transfer means are omitted from illustration.

Through the image forming processes such as charging, exposure and developing, a yellow toner image is formed on a surface of the photosensitive drum 111 rotated in a direction shown by the arrow R1.

The yellow toner image is transferred onto an intermediate transfer belt (intermediate transfer member) 115*a* of the transfer device 115. The intermediate transfer belt 115*a* mounted around rollers 115*b*, 115*c* and 115*d* is rotated in a direction shown by the arrow R5. By applying first transfer bias to a first transfer roller 115*e*, the yellow toner image on the photosensitive drum 111 is first-transferred at a first transfer nip $T_1$. Similarly, a magenta toner image, a cyan toner image and a black toner image are successively formed on the photosensitive drum 111 and are successively first-transferred onto the intermediate transfer belt 115*a*. As a result, four color toner images are superimposed on the intermediate transfer belt 115*a*. The four color toner images are secondary-transferred onto a transfer material P such as a paper sheet at a secondary transfer nip $T_2$ by applying secondary transfer bias to a secondary transfer roller 115*f* from a constant voltage power source 210 by using the above-mentioned constant current control method.

After the secondary transferring, the transfer material P is sent to a fixing device (not shown), where the toner images are fixed to the transfer material. However, in the above-mentioned constant current control method, during the control, if a load is varied abruptly, there arises a problem that it takes a long time to converge the current to the target current value.

As shown in a graph in FIG. 21, although the converging time t depends upon the voltage change width ΔV, if the voltage change width ΔV is great, merely when the current is slightly deviated from the target current value, the voltage is greatly changed not to converge the current. Therefore, the voltage change width ΔV must be small, with the result that, if the load is varied abruptly, it takes a long time to converge the current to the target current value.

Further, if noise is generated in the current detection signal inputted from the current detect means 220 to the CPU 230 to vibrate the current detection signal, there arises a problem that, even after the control, the voltage is vibrated. To solve this problem, the generation of noise should be disposed of or noise should not be carried on a signal in a communication path, but it is very expensive to eliminate noise completely.

Further, in the above-mentioned conventional constant current control method, apart from the above-mentioned load variation, there arises a problem that it takes a long time to converge the current from the initiation of the control. The reason is that, since the control is started at the same time when the first voltage is applied, the control is effected before the voltage is risen up, with the result that overshoot of current occurs to delay the convergence of the current.

Further, in the above-mentioned image forming apparatus, there arises a problem that the transferring property of the secondary transferring is changed in accordance with the condition of the transfer material P (for example, a pass width of the transfer material (a length of the transfer material in a direction perpendicular to the conveying direction)), or a process speed, or a mono-color image or a full color image, or a one-face mode or a both-face mode, or resistance of the transfer material. This is caused by the fact that, in dependence upon the condition of the transfer material, a ratio between current flowing through the sheet pass portion (portion where the transfer material exists at the transfer nip $T_2$) and the sheet non-pass portion (portion where the transfer material does not exist at the transfer nip $T_2$) is changed.

Regarding the variation of the pass width, in order to stabilize the transfer property, although the current flowing through the sheet pass portion must be constant, in the above-mentioned constant voltage power source 210, since the control is effected so that the sum of the current flowing through the sheet pass portion and the current flowing through the sheet non-pass portion becomes constant, if the pass width of the sheet is changed, the transfer property is changed.

Further, when a distance between the secondary transfer roller 115*f* and the fixing device is selected to become smaller than a maximum size of the transfer material (length of a maximum transfer material in the conveying direction) to make the image forming apparatus compact, the longer transfer material may be subjected to the influence from the secondary transfer roller 115*f* and the fixing device simultaneously. In such a case, if a fixing speed is reduced to ensure the good fixing ability, a transfer speed must be reduced accordingly. If the transfer speed is changed in this way, in the constant current control effected by using the constant voltage power source 210, the transfer property will be varied. The reason is that, in the constant voltage power source 210, since the control is effected with the same current value even when the transfer speed is changed, an amount of shifted charges per unit area is changed.

Furthermore, the transfer property is changed in accordance with the mono-color mode or the full-color mode. The reason is that, in the mono-color mode, the intermediate transfer belt 115*a* is rotated only by one revolution to form the image on the transfer material P. Whereas, in the full-color mode, since the intermediate transfer belt 115*a* is rotated at least by four revolutions, the charge amount of toner (before the secondary transferring) on the intermediate transfer belt 115*a* differs between the mono-color mode and the full-color mode, with the result that the optimum current value of the secondary transferring is changed.

Further, the transfer property is changed in accordance with the one-face mode (in which an image is formed on a single surface of the transfer material) or the both-face mode (in which images are formed on both surfaces of the transfer material). The reason is that, in the both-face mode, when the image is formed on a second surface of the transfer material, after the image was formed on a first surface of the transfer material, since the transfer material is once passed through the fixing device to be heated thereby, moisture is vapored to change the resistance of the transfer material.

SUMMARY OF THE INVENTION

An object of the present invention is to provide a stable constant current control method in which current can be converged to a target current value quickly even if abrupt change in a load occurs.

Another object of the present invention is to provide a constant current control method in which influence of noise can be eliminated without "cost-up".

A further object of the present invention is to provide a constant current control method in which control time can be reduced and the control can be stabilized.

A still further object of the present invention is to provide an image forming apparatus using the above-mentioned constant current control method.

The other object of the present invention is to provide an image forming apparatus in which an image can be transferred onto a transfer material even when a size and a condition of the transfer material are changed.

DETAILED DESCRIPTION OF THE PREFERRED EMBODIMENTS

A constant current control method and an image forming apparatus according to the present invention will be now explained with reference to the accompanying drawings.

Figure 12:
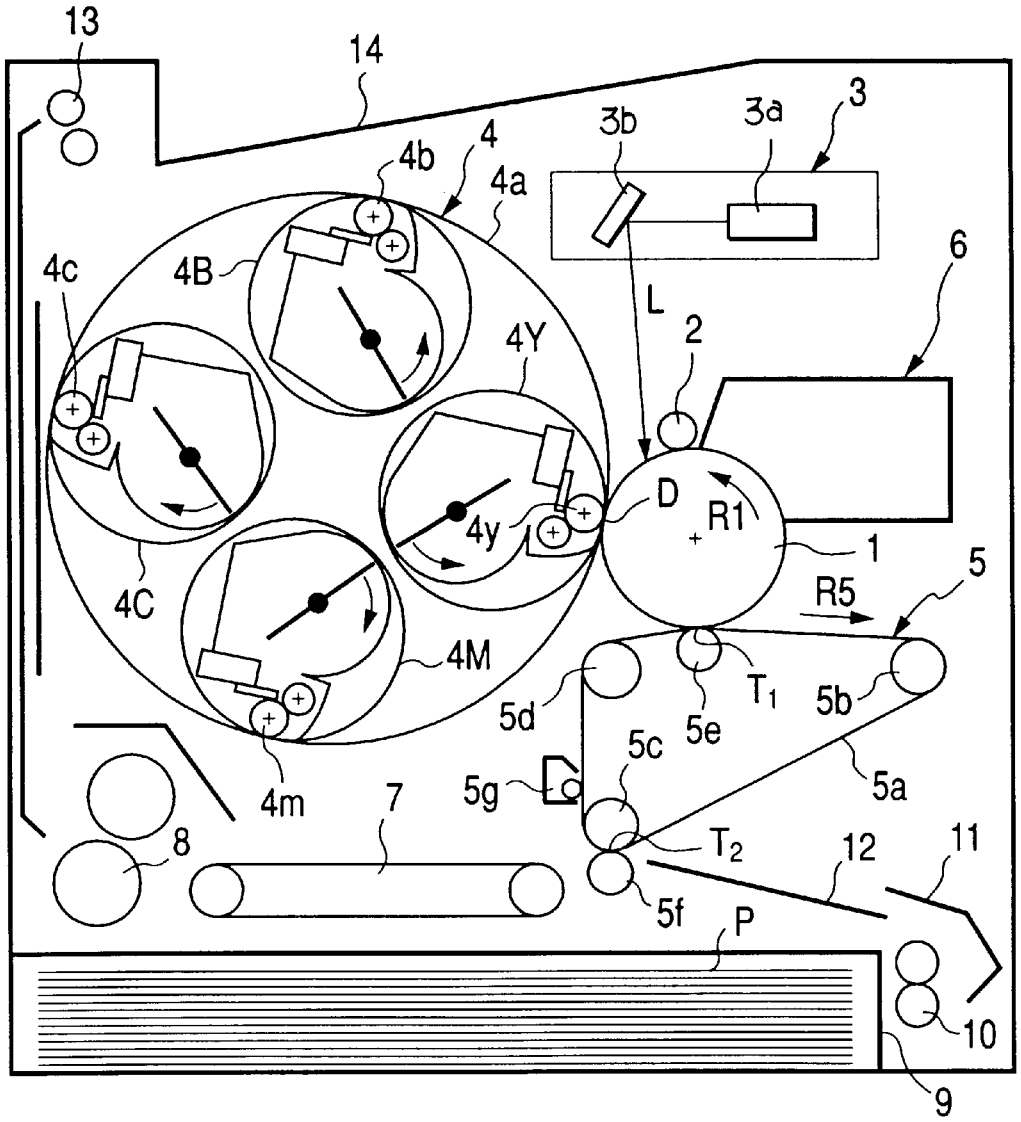
FIG. 12 is an elevational sectional view of an image forming apparatus according to the present invention.

FIG. 12 shows a schematic construction of an image forming apparatus according to the present invention. Incidentally, FIG. 12 shows a four full-color laser beam printer having an intermediate transfer belt 5*a* as an intermediate transfer member (second image bearing member). Now, the construction and image forming process of the image forming apparatus will be briefly explained with reference to FIG. 12. In this image forming apparatus, yellow, magenta, cyan and black toner images can successively be transferred onto the intermediate transfer member to form a four full-color image on a transfer material.

The image forming apparatus shown in FIG. 12 has a photosensitive member 1 as a first image bearing member of electrophotographic drum type (referred to as "photosensitive drum" hereinafter). The photosensitive drum 1 includes a cylindrical conductive aluminum drum base and a photosensitive body (photosensitive layer) formed on a peripheral surface of the drum base. The photosensitive body may be, for example, photo-conductor such as OPC (organic photo semi-conductor), A-Si (amorphous silicon), CdS (cadmium sulfide) or Se (selenium). The photosensitive drum 1 is rotatably supported by a body (not shown) of the image forming apparatus and is rotated by a drive means (not shown) at a predetermined process speed in a direction shown by the arrow R1.

The photosensitive drum 1 is uniformly charged with predetermined polarity and predetermined potential by applying charge bias from a charge source (not shown) to a charge roller (charger) 2 contacted with the photosensitive drum. After the charging, an electrostatic latent image is formed on the surface of the photosensitive drum 1 by an exposure device 3. The exposure device 3 includes a light source 3*a*, a polygon mirror (not shown), a lens (not shown), and a reflection mirror (3*b*) and serves to form an electrostatic latent image corresponding to yellow color by scanning the surface of the photosensitive drum 1 by a laser beam L generated in response to an yellow (first color) image signal.

The electrostatic latent image is developed by a developing means 4. The developing means 4 includes a rotatable rotary 4*a*, and four developing devices (developing devices 4Y, 4M, 4C and 4B containing yellow toner, magenta toner, cyan toner and black toner, respectively) mounted on the rotary. By rotating the rotary 4*a*, the yellow developing device 4Y used in the development of the electrostatic latent image formed on the photosensitive drum 1 is brought to a developing position D where the yellow developing device is opposed to the photosensitive drum 1. By applying the developing bias to the developing device 4Y, i.e., developing sleeve 4*y* positioned at the developing position D, the yellow toner is adhered to the electrostatic latent image formed on the photosensitive drum 1, thereby forming an yellow toner image.

The yellow toner image is first-transferred onto the intermediate transfer belt 5*a* of the transfer device 5. The intermediate transfer belt 5*a* is constituted by a rubber sheet made of EPDM, NBR (nitrile rubber), urethane or silicone rubber, or a flexible resin sheet made of PVdF (polyvinylidene fluoride) or PET (polyethylene terephtalate) and is mounted around a drive roller 5*b*, a driven roller 5*c* and a tension roller 5*d* so that, by rotating the drive roller 5*b* in a clockwise direction by means of a drive means (not shown), the intermediate transfer belt is rotatingly driven (shifted) in a direction shown by the arrow R5 at substantially the same speed as the process speed of the photosensitive drum 1. Inside the intermediate transfer belt 5*a*, there is disposed a first transfer roller 5*e*, and the first transfer roller 5*e* cooperates with the photosensitive drum 1 to pinch the intermediate transfer belt 5*a* therebetween, thereby forming a first transfer nip $T_1$ between the intermediate transfer belt 5*a* and the first transfer roller. Predetermined first transfer bias is applied to the first transfer roller 5*e* from a high voltage power source (not shown), with the result that the yellow toner image formed on the photosensitive drum 1 is first-transferred onto the intermediate transfer belt 5*a*. After the toner image was transferred, first transfer residual toner remaining on the photosensitive drum 1 is removed by a cleaner 6, thereby preparing for next image formation of a magenta image.

The above-mentioned series of image forming processes regarding the yellow toner (charging, exposure, developing, first transferring and cleaning) are similarly performed regarding the other three colors (magenta, cyan and black), and ultimately, four color images are successively first-transferred onto the intermediate transfer belt 5*a* in a superimposed fashion.

Then, the four color toner images on the intermediate transfer belt 5*a* are transferred onto a transfer material P such as a paper sheet. A secondary transfer roller 5*f* is disposed outside the intermediate transfer belt 5*a*, and the secondary transfer roller 5*f*cooperates with the driven roller 5*c* to pinch the intermediate transfer belt 5*a* therebetween, thereby forming a secondary transfer nip $T_2$ between the intermediate transfer belt 5*a* and the secondary transfer roller. The transfer materials P are contained within a sheet supply cassette 9 and each transfer material is supplied by a sheet supply roller 10 along guide members 11, 12, and, is supplied to the secondary transfer nip $T_2$ in synchronous with the rotation of the intermediate transfer belt 5*a*. The four color toner images on the intermediate transfer belt 5*a* are collectively secondary-transferred onto the transfer material P supplied to the secondary transfer nip $T_2$ by applying secondary transfer bias to the secondary transfer roller 5*f* from a high voltage source (not shown).

After the toner images were secondary-transferred, the transfer material P is conveyed, by a convey belt 7, to a fixing device 8, where the toner images are fixed to the surface of the transfer material by heat and pressure. Thereafter, the transfer material is discharged, by a discharge roller 13, onto a discharge tray 14 provided on the upper surface of the body of the image forming apparatus. In this way, the color image formation is finished. On the other hand, after the secondary-transferring of the toner, secondary transfer residual toner remaining on the intermediate transfer belt 5*a* is removed by a cleaning device 5*g* comprising a fur brush or a web which can engaged by and disengaged from the intermediate transfer belt, thereby preparing for the first transferring of a next toner image.

Regarding the above-mentioned image forming processes, while an example that four full-color image is formed was explained, a mono-color image (for example, a black color image) may be formed. The number of colors may be selected appropriately in accordance with an original.

Figure 19:
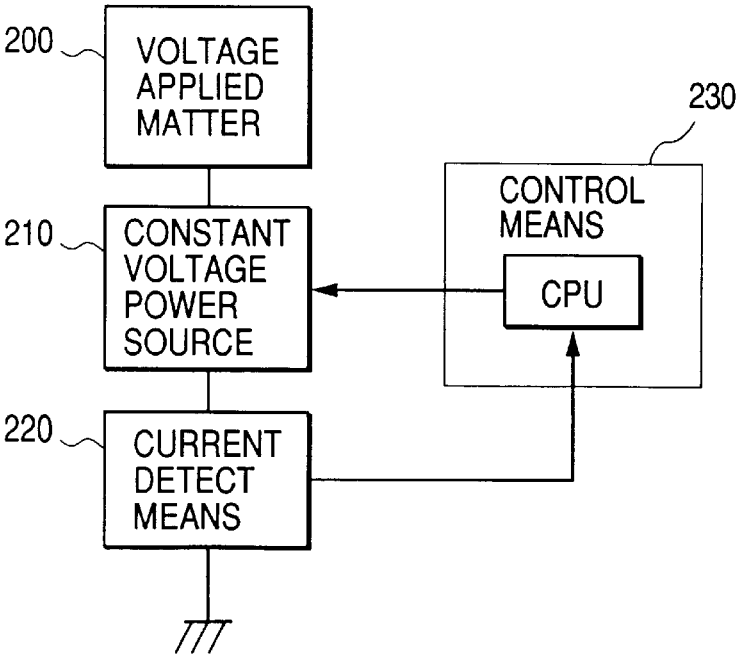
FIG. 19 is a block diagram showing the constant current control method according to the present invention.

In the image forming apparatus having the above-mentioned construction, the voltage applied matter (voltage applied member) 200 which is shown in FIG. 19 and to which the constant current control method according to the present invention is applied may be the first charge device 10, developing sleeves 4*y*, 4*m*, 4*c* and 4*b*, first transfer roller 5*e* or secondary transfer roller 5*f*. It is preferable that the voltage applied matter 200 is contacted with the charging means.

In case of the first charge device 10, the constant current control method according to the present invention which will be fully described later is applied during the voltage is being applied to the first charge device 10 to charge the photosensitive drum 1, or during the voltage is being applied to the developing sleeve 4*y*, 4*m*, 4*c* and 4*b* of the corresponding developing device 4Y, 4M, 4C and 4B to form the toner image, or during the voltage is being applied to the first transfer roller 5*e* to transfer the toner image on the photosensitive drum 1 onto the intermediate transfer belt 5*a*, or the voltage is being applied to the secondary transfer roller 5*f* to transfer the toner images on the intermediate transfer belt 5*a*onto the transfer material P.

First Embodiment

Figure 20:
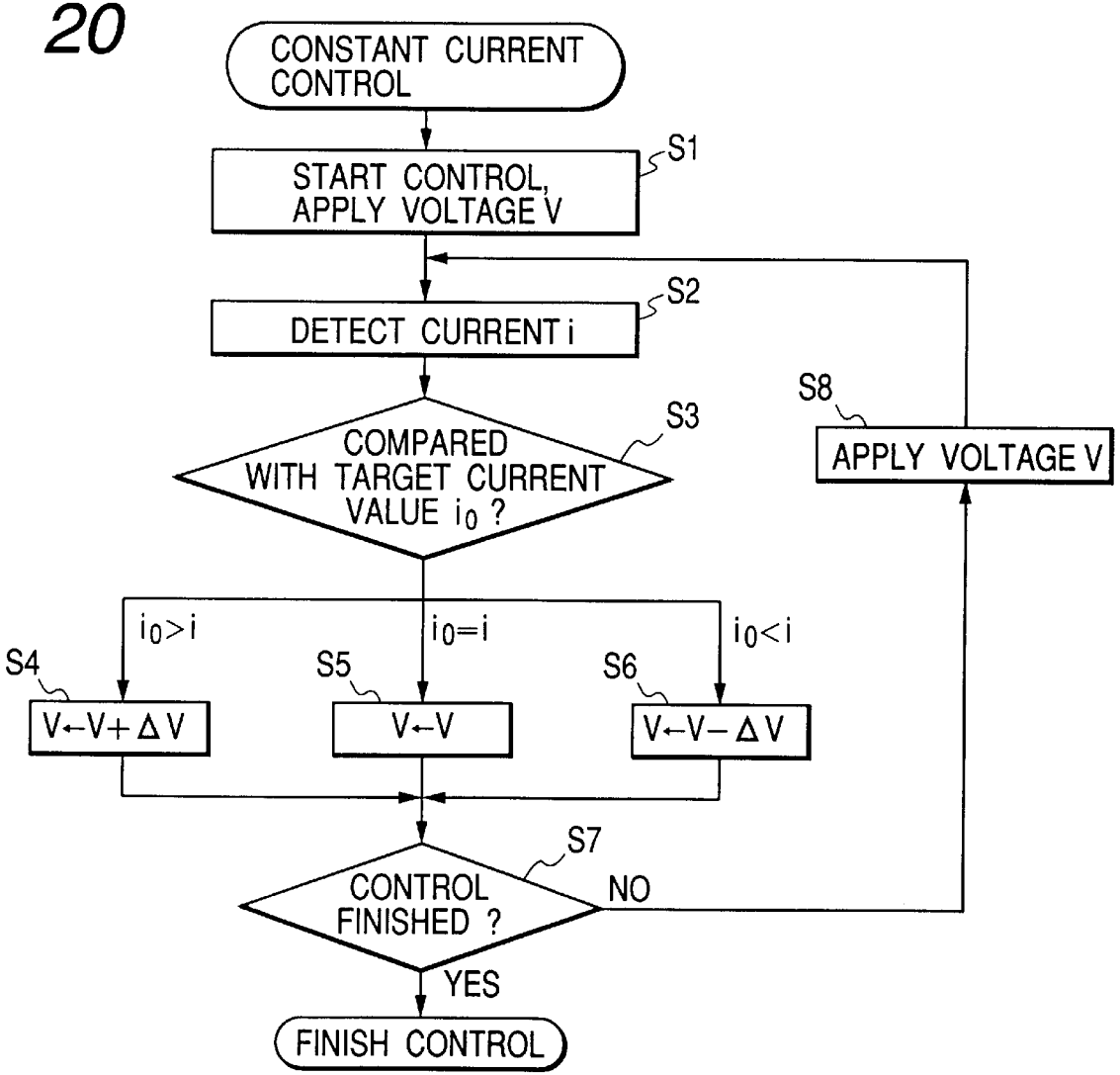
FIG. 20 is a flow chart of a conventional constant current control method.
Figure 21:
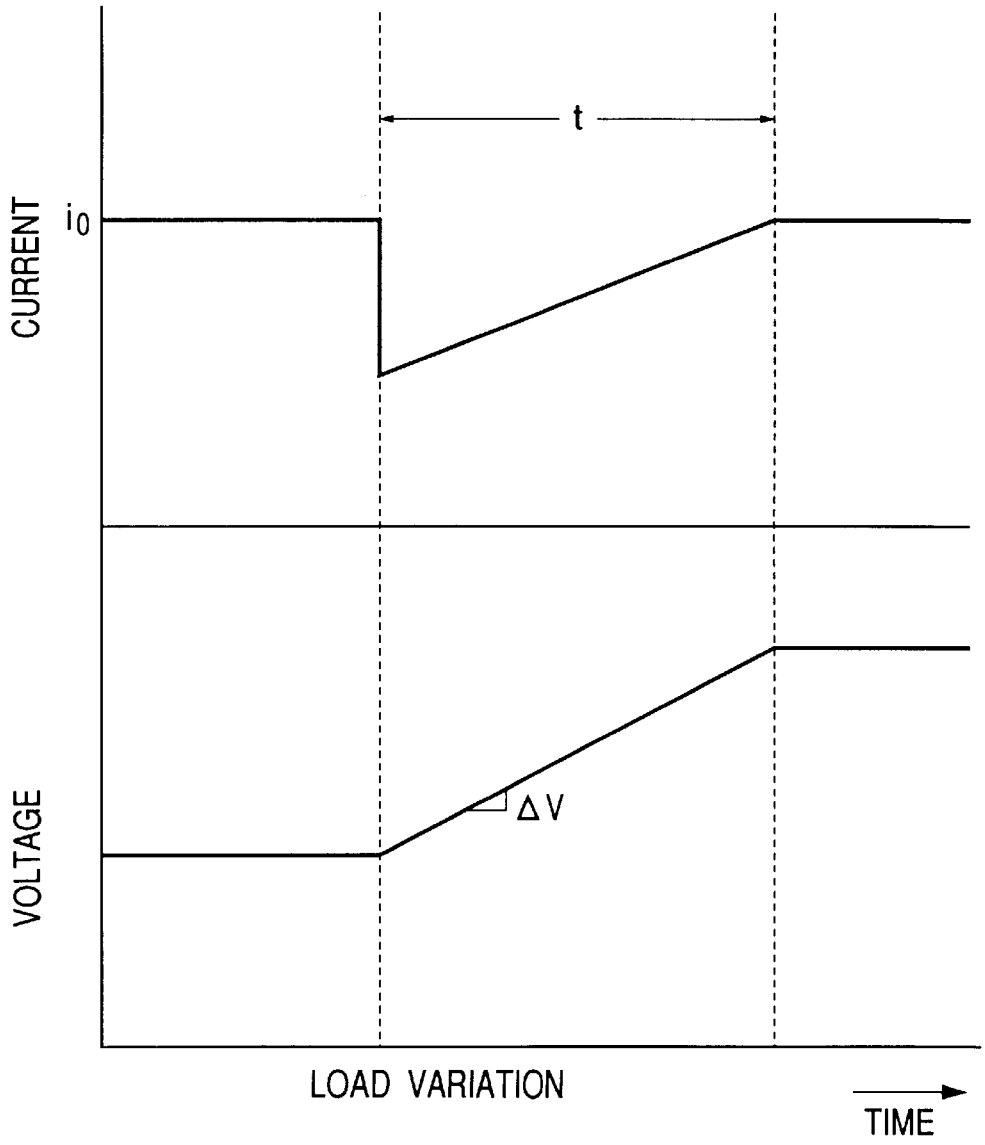
FIG. 21 is graph showing change in current and voltage in the conventional constant current control method.
Figure 22:
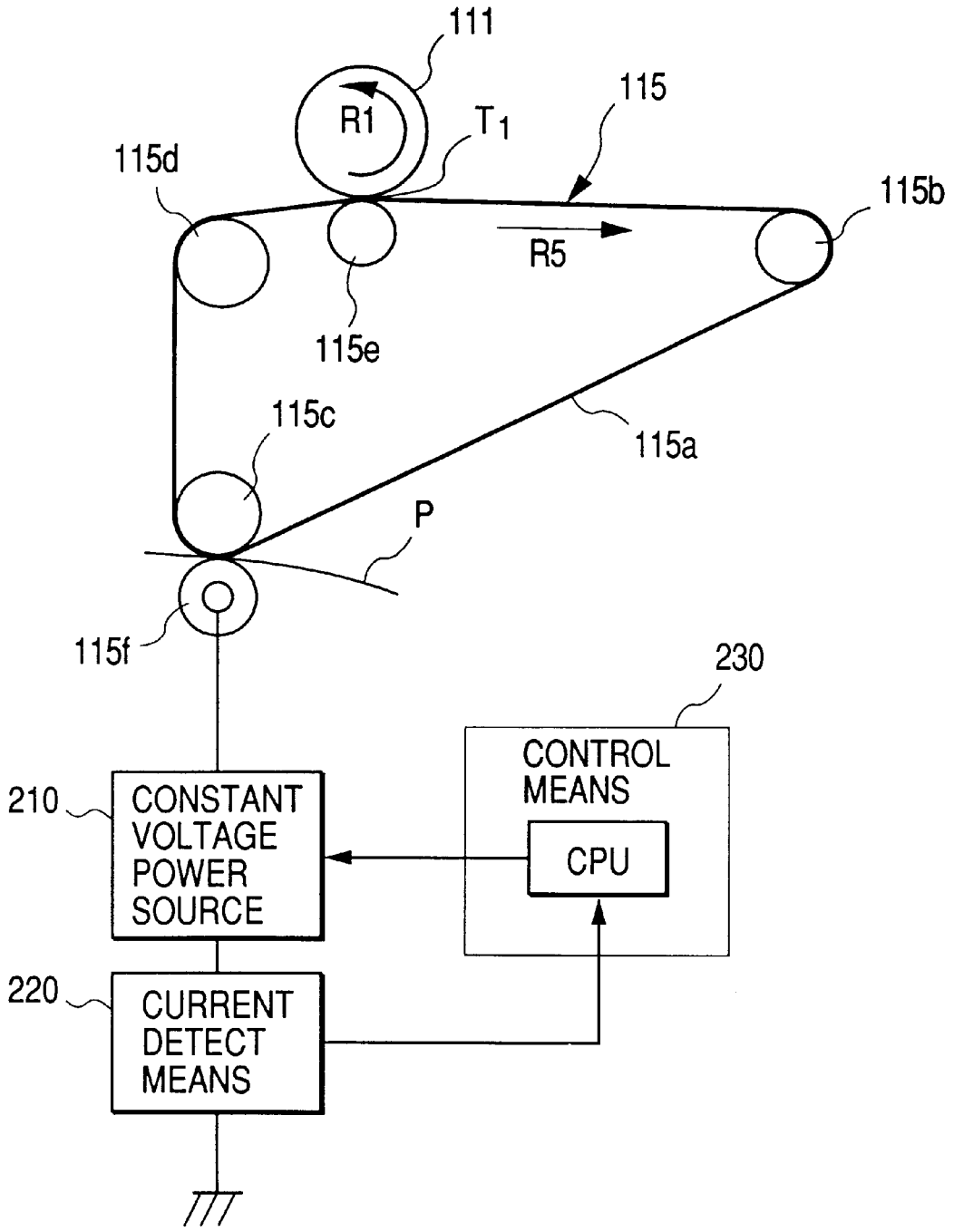
FIG. 22 is explanatory view showing conventional transfer apparatus and control thereof.

Next, a first embodiment of the constant current control method according to the present invention will be explained mainly with reference to FIGS. 1 and 2. Incidentally, in the embodiment described hereinbelow, the constant current control method according to the present invention is substantially similar to the constant current control method described in connection with FIGS. 19 and 20. Accordingly, the detailed explanation of the entire control method will be omitted, and only characteristic control algorism will be explained also with reference to FIG. 19.

In the first embodiment, the current detect means 220 for detecting the flowing current is connected to the constant voltage power source 210 for applying the voltage, and constant current is obtained by controlling the constant voltage power source 210 by the CPU 230 so that the current becomes a predetermined value. And, in the illustrated embodiment, a plurality of voltage change widths are previously prepared, and the voltage change widths are switched in accordance with the difference between the target current: value and the present current value detected by the current detect means 220.

As mentioned above, in the conventional method, if the abrupt load variation occurs, it takes a long time to converge the current to the target current value. Although the converging time t depends upon the voltage change width ΔV, if the width ΔV is great, merely when the current is slightly deviated from the target current value, the voltage is greatly changed to vibrate the current. Therefore, the voltage change width ΔV must be small, with the result that, if the load is varied abruptly, it takes a long time to converge the current to the target current value.

Figure 1:
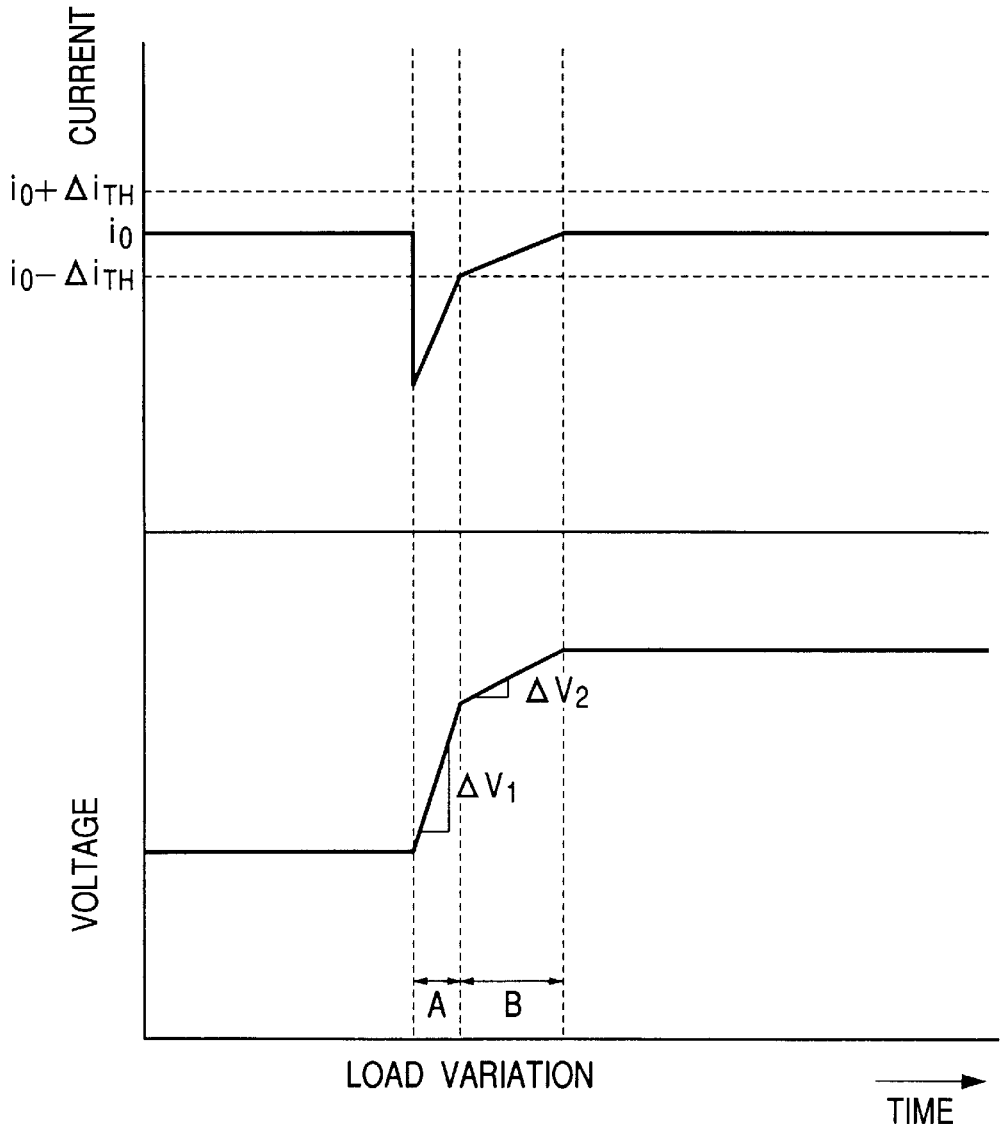
FIG. 1 is a graph showing change in current and voltage in a constant current control method according to a first embodiment of the present invention.

In consideration of the above, in the illustrated embodiment, as shown in FIG. 1, the control is effected by switching between a rough zone (A area) where the current change width (ΔV1) is great and a fine zone (B area) where the current change width (ΔV2) is small. Regarding such switching, a threshold current value ΔiTH is previously determined, and if the present current value satisfies the following relation (1), i.e., if the present current value is not so deviated from the target current value, the control is effected with the fine zone (B area); otherwise, i.e., if the present current value is greatly deviated from the target current value, the control is effected with the rough zone (A area):

$$i0-\Delta iTH<i<i0+\Delta iTH$$

Figure 2:
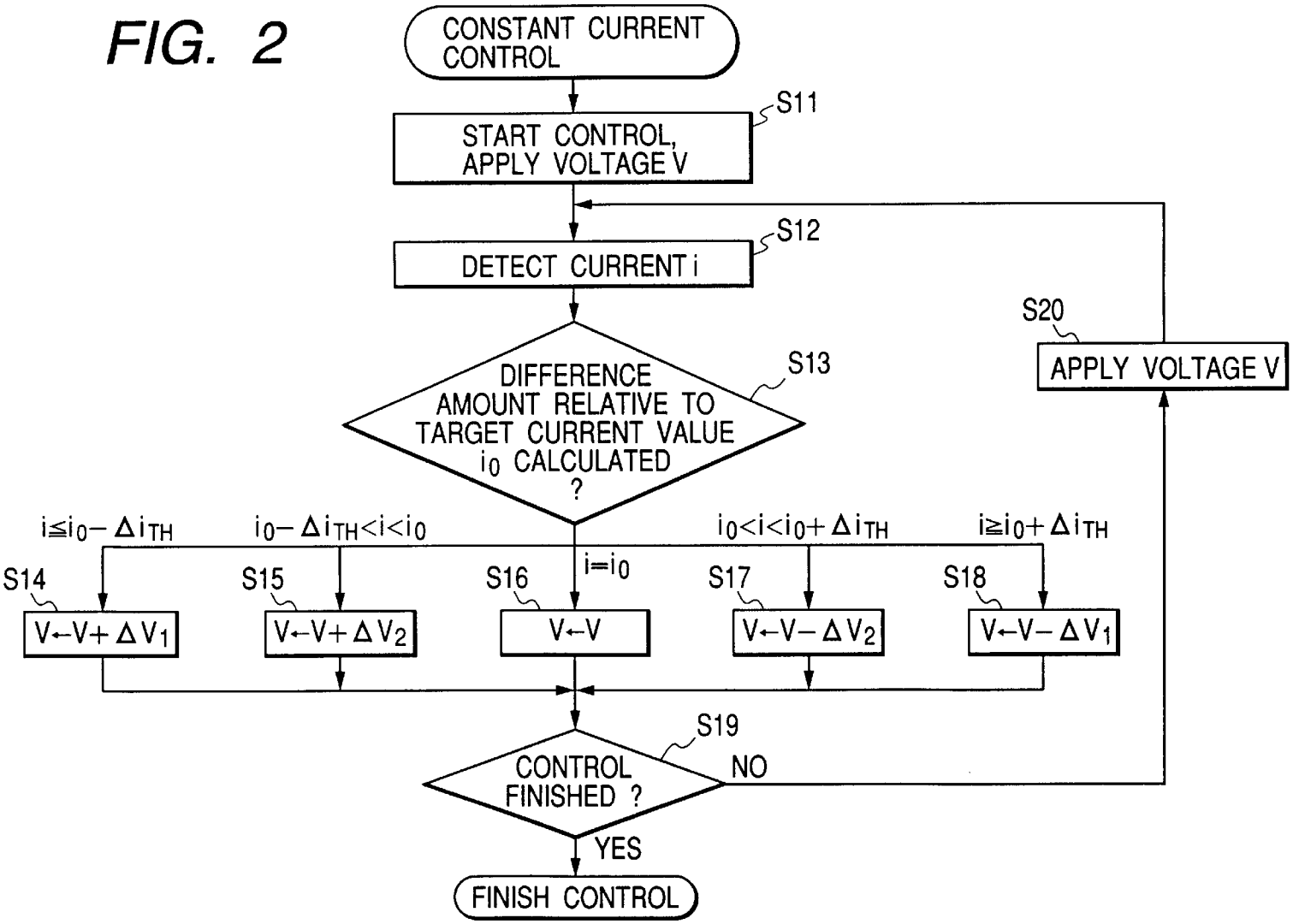
FIG. 2 is a flow chart regarding the constant current control method according to the first. embodiment.

FIG. 2 shows a flow chart regarding such control. In FIG. 2, when the constant current control is started to apply the voltage V to the voltage applied body 200 (step 11), a value of the flowing current is detected by the current detect means 220 and then the current is converted into an analogue signal of 5V which is in turn inputted to the CPU 230. The detection signal inputted to the CPU 230 is A/D-converted into 8-bit value (step 12).

A current value i obtained in this way is: compared with a target current value i0 in the CPU 230 (step 13). In this case, in accordance with the above-mentioned predetermined threshold value ΔiTH, (a) if i≦i0−ΔiTH, the voltage of (V+ΔV1) is set (step 14);

(b) if i0−ΔiTH≦i<i0, the voltage of (V+ΔV2) is set (step 15);

(c) if i=i0, i.e. if the difference is zero, the present current is set as it is (step 16);

(d) if i0<i<i0+ΔiTH, the voltage of (V−ΔV2) is set (step 17); and (e) if i≧i0+ΔiTH, the voltage of (V−ΔV1) is set (step 18).

After it is judged whether the control is finished or not (step 19), if negative, the constant voltage power source 210 applies the voltage V to the voltage applied matter 200 in accordance with the voltage value outputted from the CPU 230 (step 20). By repeating this operation, the current is converged to the target current value, thereby achieving the constant current control. In this way, even if the load is varied abruptly during the control, as shown in FIG. 1, the current is converged to the target current value for a relatively short time, thereby achieving the stable constant current control.

Incidentally, in the illustrated embodiment, while an example that two voltage change widths ΔV1, ΔV2 are previously prepared and the control is effected by switching such voltage change widths was explained, three or more voltage change widths may be prepared and the control may be effected by switching such voltage change widths. In this case, the speed of the convergence of the current to the target current value can be increased.

Second Embodiment

Next, a second embodiment of the present invention will be explained with reference to FIGS. 3 and 4. In this embodiment, in accordance with the difference in current between the target current value and the present current value, the change width of the voltage is changed.

Figure 3:
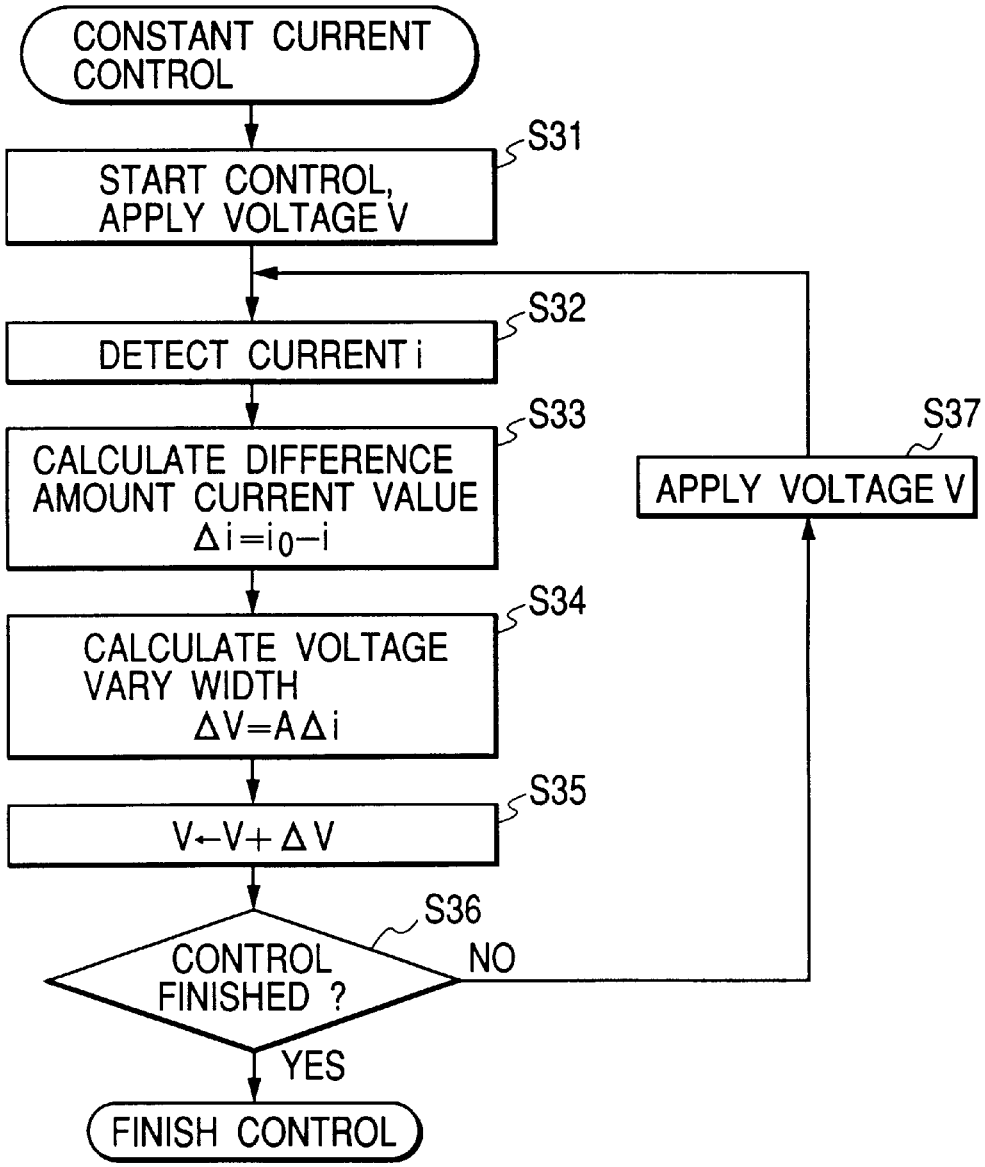
FIG. 3 is a flow chart regarding a constant current control method according to a second embodiment of the present invention.

Explaining more in detail with reference to a flow chart shown in FIG. 3, the constant current control is started to apply the voltage V to the voltage applied matter 200 (step 31), and a value i of the flowing current is detected (step 32). After the current value i was detected, the difference current value Δi (=i0−i) between the target current value i0 and the present current value is calculated (step 33). The voltage change width ΔV (=AΔi) is calculated by multiplying the different current value Δi by a predetermined constant A (step 34). The present voltage value is determined by adding the voltage change width to the previous voltage value V (step 35). After it is judged whether the control is finished or not (step 36), if negative, the constant voltage power source 210 applies the voltage V to the voltage applied matter 200 in accordance with the voltage value outputted from the CPU 230 (step 37). By repeating this operation, the current is converged to the target current value, thereby achieving the constant current control.

Figure 4:
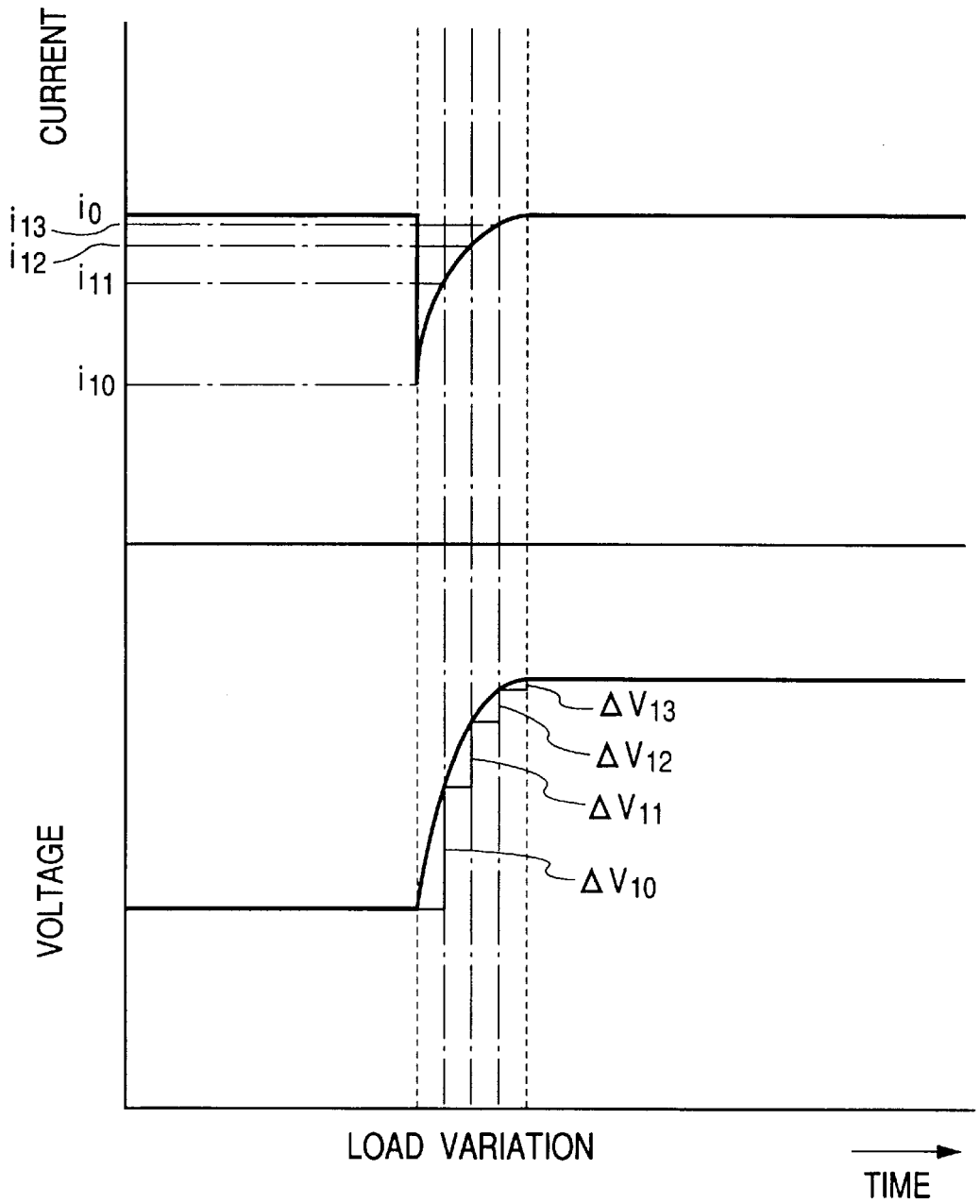
FIG. 4 is a graph showing change in current and voltage in the constant current control method according to the second embodiment.

Further explaining with reference to FIG. 4, if the current does not flow due to the abrupt load variation (i10), the difference Δi10 (=i0−i10) between the current value and the target current value i0 becomes great, and, the corresponding great voltage change width ΔV10 (=AΔi10) is added to the present voltage V and the result is outputted. Thereafter, similarly, the voltage change widths ΔV11, ΔV12, ΔV13 corresponding to the difference current values obtained from the current values i11, i12 and i13 are added and the results are outputted. In this way, if the present current value is greatly deviated from the target current value, the correction can be made with the great voltage change width, and, if the present current value is near the target current value, the correction can be made with the small voltage change width, with the result that the speed of convergence of the current to the target current value can be increased.

Third Embodiment

Next, a third embodiment of the present invention will be explained with reference to FIGS. 5 to 7. In this embodiment, the target current value has a predetermined width.

Figure 5:
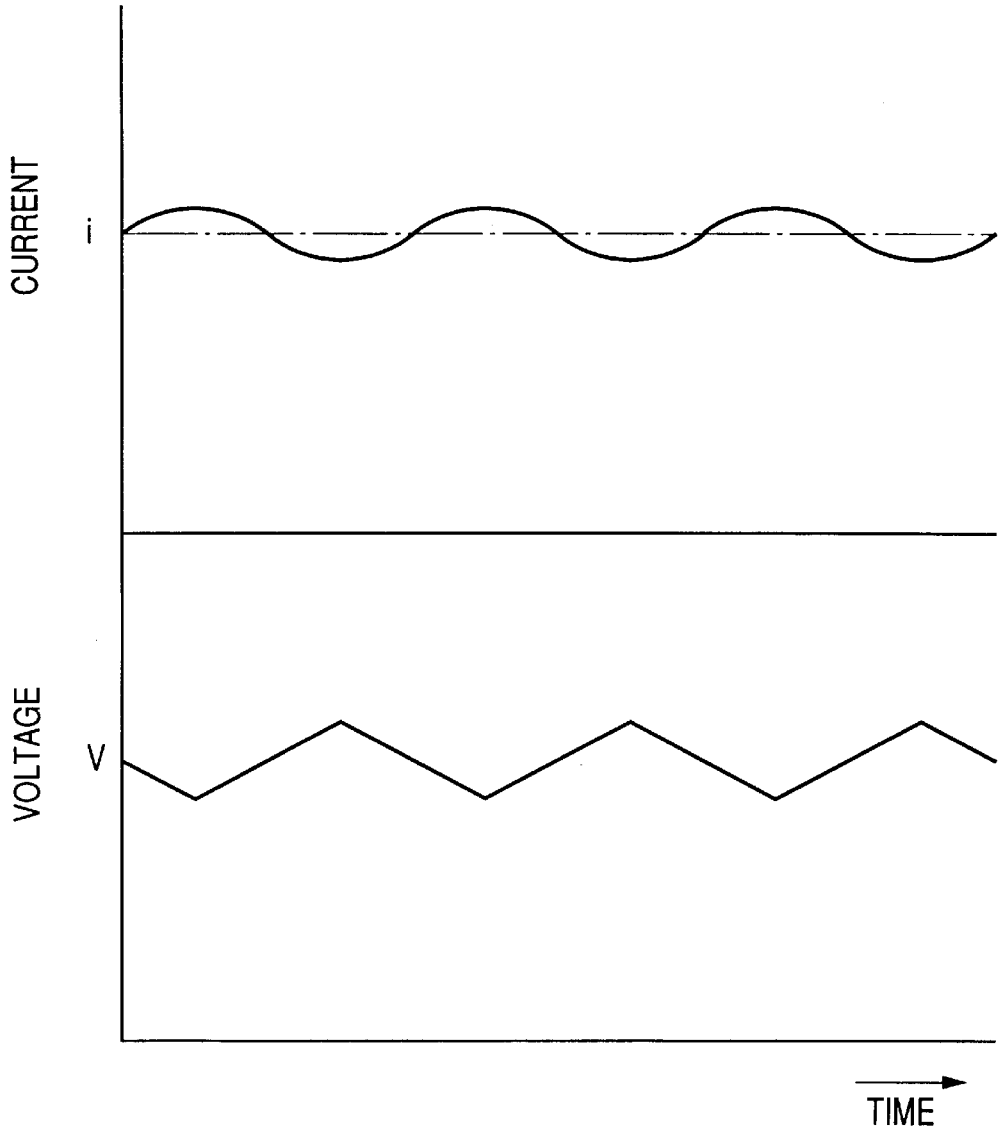
FIG. 5 is a graph showing change in current and voltage in a conventional constant current control method when noise is generated in current.
Figure 6:
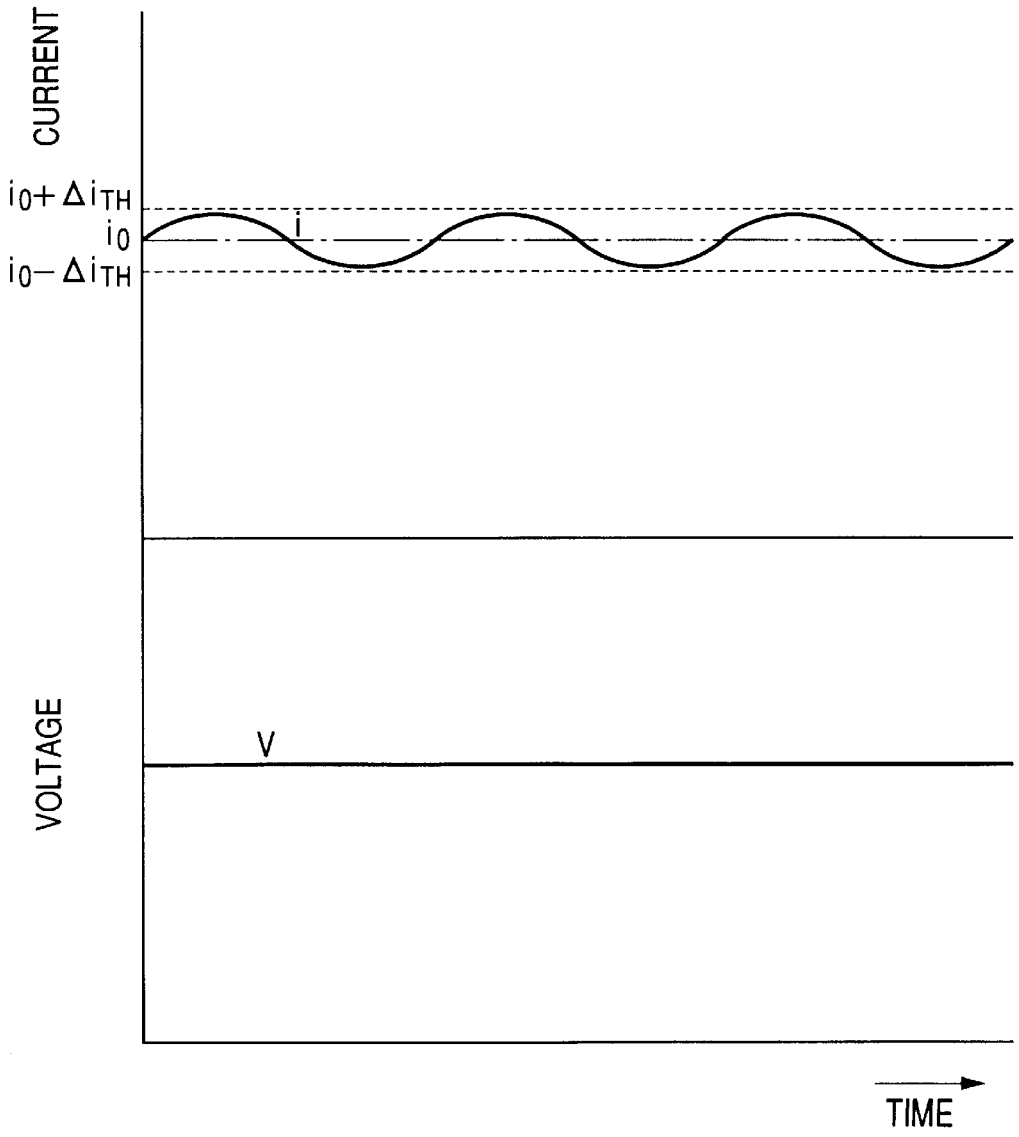
FIG. 6 is a graph showing change in current and voltage in a constant current control method according to a third embodiment of the present invention.

Explaining in more detail, as shown in FIG. 5, if noise is generated in the current detection signal inputted to the CPU 230 from the current detect means 220 to vibrate the current with frequency longer than sampling frequency of the CPU 230, the output voltage V after the control is also vibrated. To avoid this, in the third embodiment, the target current value has the predetermined width.

Figure 7:
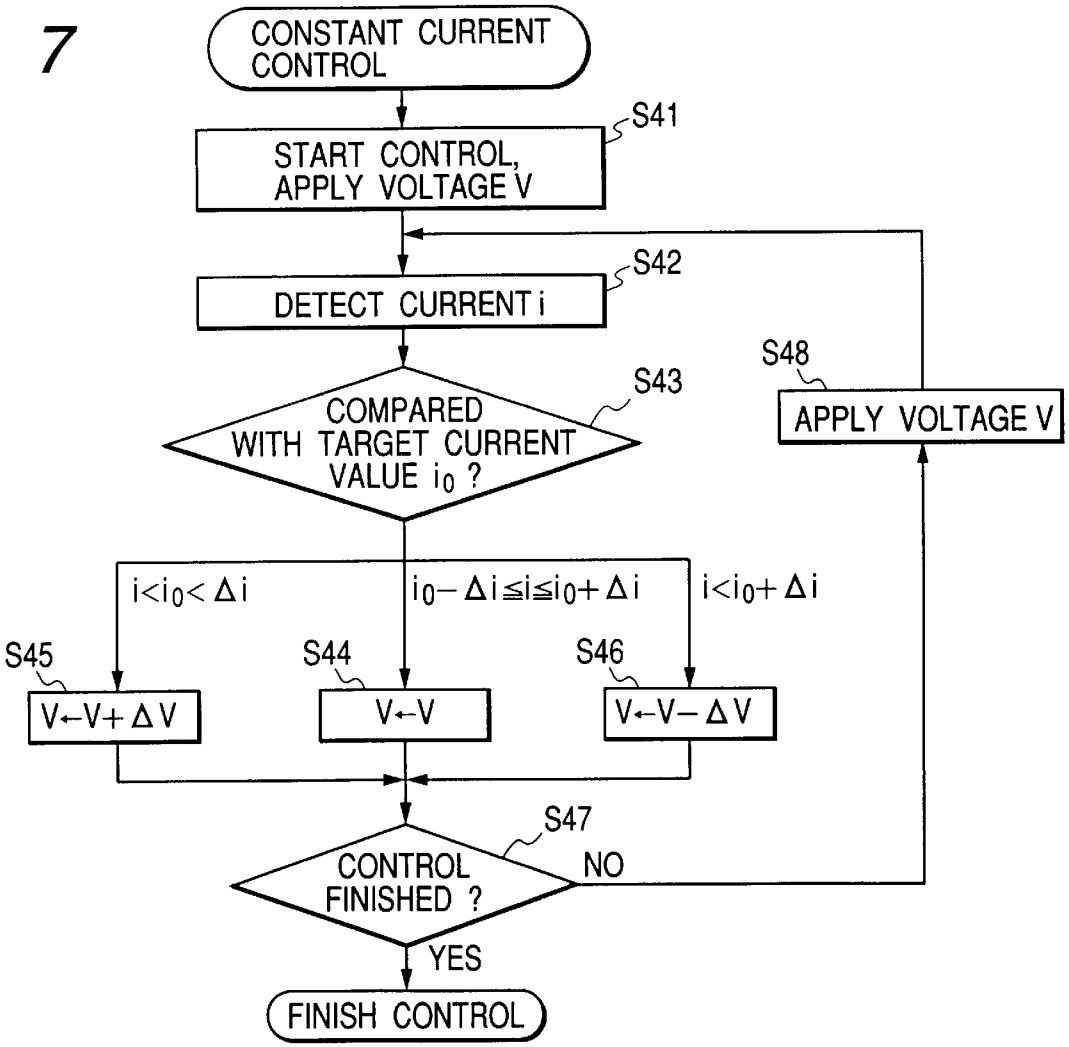
FIG. 7 is a flow chart regarding the constant current control method according to the third embodiment.

Further explaining with reference to a flow chart shown in FIG. 7, in the illustrated embodiment, the constant current control is started to apply the voltage V to the voltage applied matter 200 (step 41), and a value of the flowing current due to the apply voltage is detected (step 42). A value $\Delta I$ greater than amplitude of the noise is prepared, and the target current value is set to $i0\pm\Delta I$. The detected current value i is compared with the target current value $i0\pm\Delta I$ (step 43). If the present current value i is included within the target current value $i0\pm\Delta I$, i.e., if $(i0-\Delta I)\leqq i\leqq(i0+\Delta I)$ (step 44), the previous voltage value is set as it is (step 44); whereas, if the present current value i is not included within the target current value, i.e., if $i<(i0-\Delta I)$ or if $i>(i0+\Delta I)$, as is in the conventional case, the value obtained by adding the voltage change width $\Delta V$ to the previous voltage value (i.e., $V+\Delta V$) is set (step 45) or the voltage value $(V-\Delta V)$ is set (step 46). After it is judged whether the control is finished or not (step 47), if negative, the constant voltage power source 210 applies the voltage V to the voltage applied matter 200 in accordance with the voltage value outputted from the CPU 230 (step 37). In this way, the noise can be eliminated without making the apparatus expensive, thereby achieving the stable constant current control.

Fourth Embodiment

Next, a fourth embodiment of the present invention will be explained with reference to FIGS. 8 and 9. In this fourth embodiment, the voltage change width is varied in dependence upon increase/decrease of the voltage.

Figure 8:
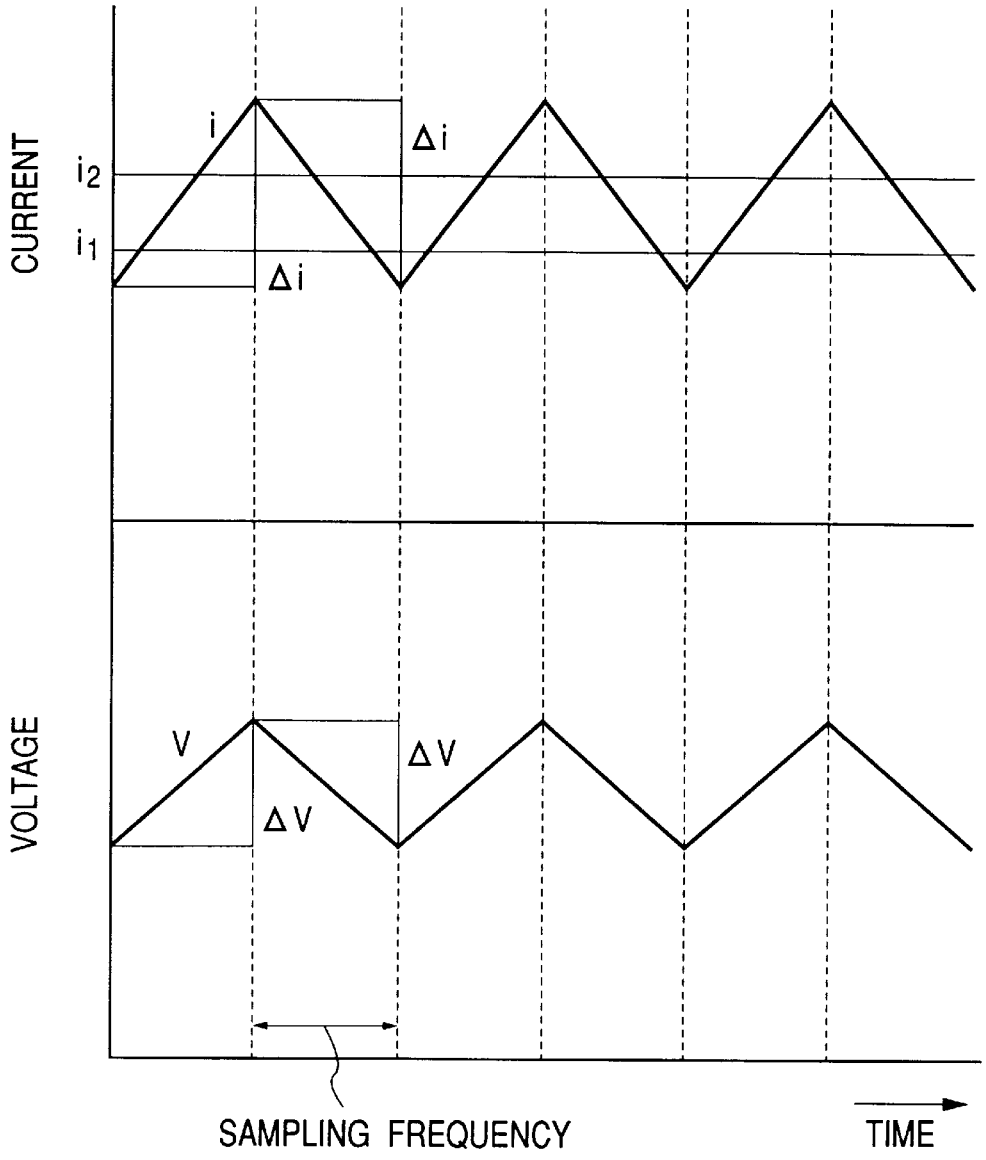
FIG. 8 is a graph showing change in current and voltage in a conventional constant current control method.
Figure 9:
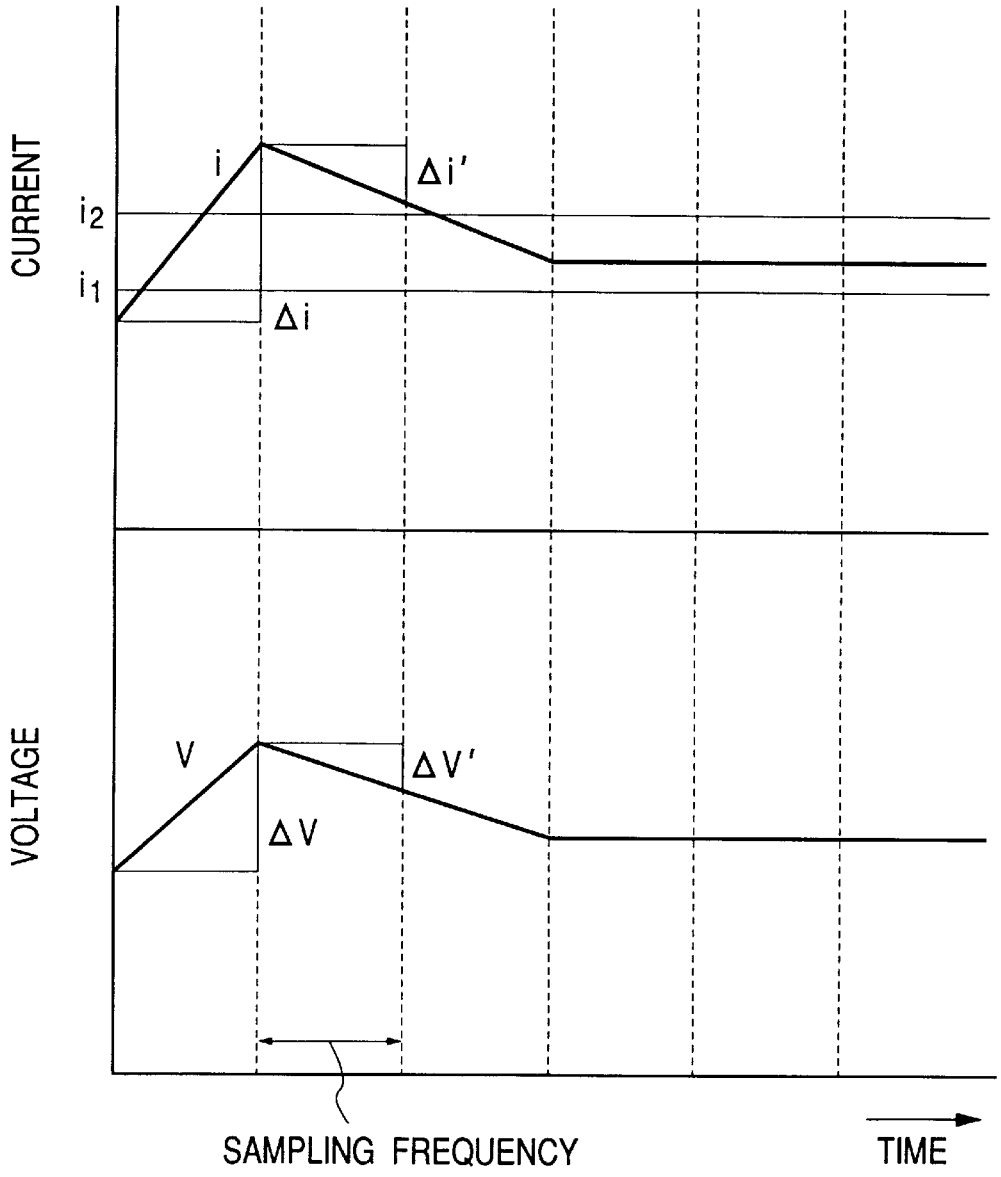
FIG. 9 is a graph showing change in current and voltage in a constant current control method according to a fourth embodiment of the present invention.

As shown in FIG. 8, if the same voltage change with $\Delta V$ is used the voltage increase side and voltage decrease side in the predetermined sampling frequency, the change widths $\Delta i$ of the current becomes the same. In this case, the current change width $\Delta i$ is varied with the load, and, if the width $\Delta i$ becomes greater than the value $(i2-i1)$, the current is not sometimes converged within the range $(i1-i2)$. If this; occurs, even when the load is constant, the output voltage is vibrated to make the control unstable.

To avoid this, in the illustrated embodiment, the voltage change width is varied in dependence upon increase/decrease of the voltage. With this arrangement, as shown in FIG. 9, since the change $\Delta i$ in current due to the change in voltage in the increase side differs from the change $\Delta i'$ in current due to the change in voltage in the decrease side, the current can be converged to the desired range regardless of the load, thereby achieving the stable constant current control.

Fifth Embodiment

Next, a fifth embodiment of the present invention will be explained with reference to FIGS. 10 and 11. In this fifth embodiment, the control is started after the voltage is risen up to a predetermined level.

Figure 10:
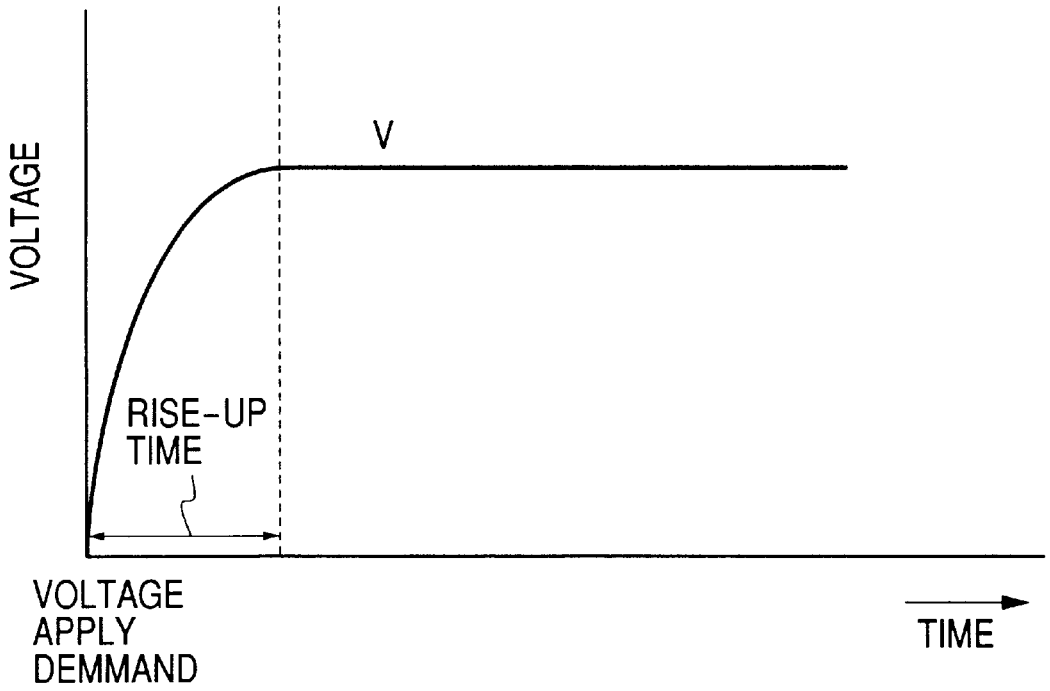
FIG. 10 is a graph showing rise-up of voltage in the constant current control method.

As shown in FIG. 10, some rising-up time is required from when voltage apply demand for the voltage applied matter 200 is emitted from the CPU 230 to when the predetermined voltage is actually applied to the voltage applied matter. In general, the time period required for rising up the voltage to the predetermined level is varied with circuit voltage and circuit property, but is generally about several tens of msec to several hundreds of msec. However, as mentioned above, in the conventional control method, since the control is started at the same time when the voltage is applied to the voltage applied matter 200, the control is effected before the voltage is risen up, with the result that the overshoot of current occurs to delay the converging time. That is to say, since it is judged that the predetermined voltage is applied in spite of the fact that the voltage is not risen up to effect the control thereby to increase the voltage, when the voltage is risen up, excessive current flows, thereby delaying the convergence of the current to the target current value.

Figure 11:
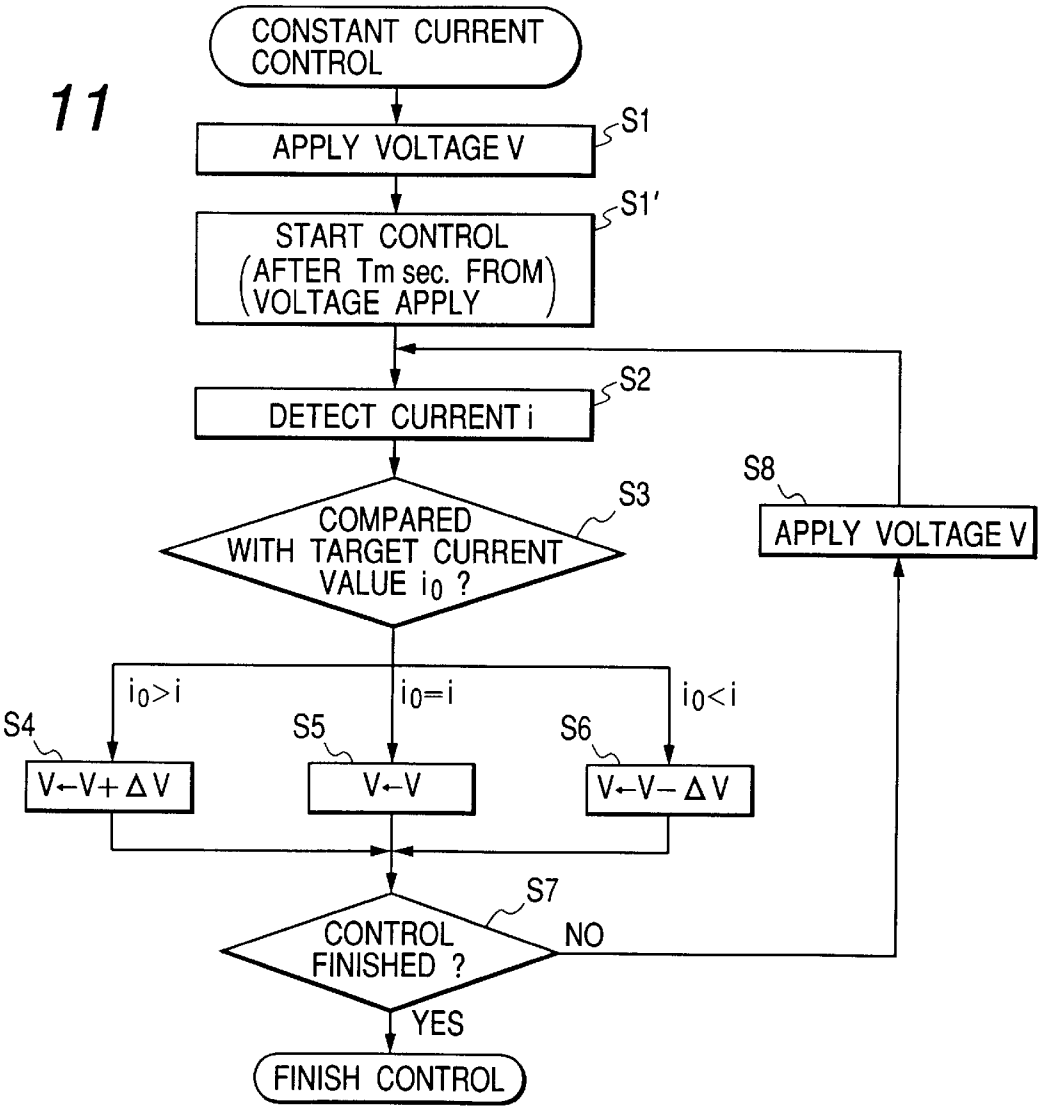
FIG. 11 is a flow chart regarding the constant current control method according to a fifth embodiment of the present invention.

To avoid this, in the illustrated embodiment, as shown in a flow chart shown in FIG. 11 (since the flow chart shown in FIG. 11 is substantially similar to the flow chart shown in FIG. 20, only characteristic portions will be explained), the constant current control is started (step 1') when a predetermined waiting time T msec (time period during which the voltage is risen up) is elapsed after the voltage apply demand for the voltage applied matter 200 is emitted from the CPU 230 (step 1). The waiting time T is preferably selected to 50 to 150 msec when the apply voltage is 1 kV. In this case, since the voltage is already risen up when the control is started, the erroneous control can be avoided, with the result that the speed for converging the current to the target current value is increased, thereby achieving the stable constant current control.

Incidentally, in the above-mentioned first to fifth embodiments, while an example that the present invention is applied to the full-color image forming apparatus shown in FIG. 12 was explained, the present invention can be applied to image forming apparatuses of other type.

Figure 17:
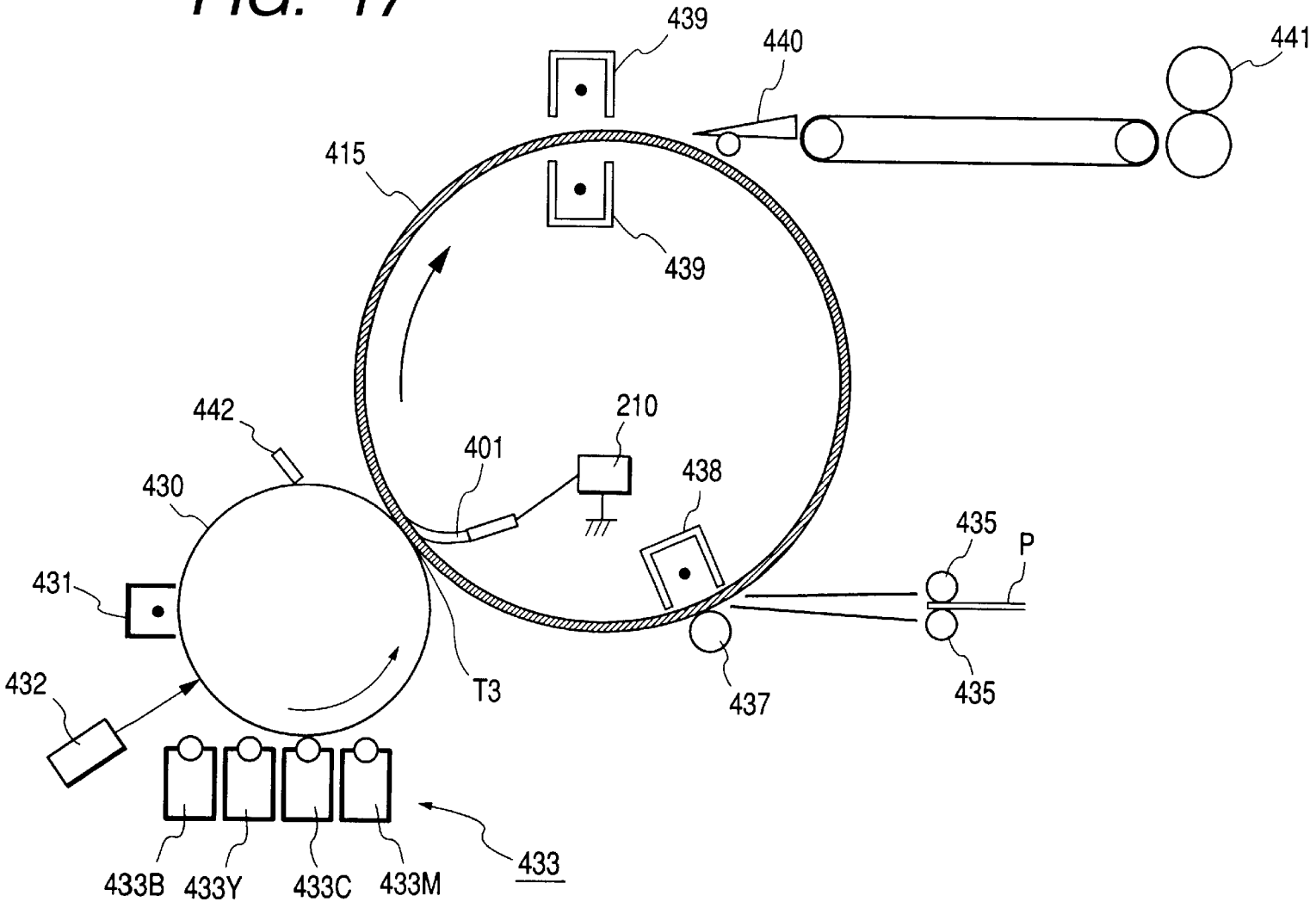
FIGS. 17 and 18 are explanatory views showing a schematic construction of an image forming apparatus according to the present invention.

For example, in a color image forming apparatus (as shown in FIG. 17) in which a toner image on a photosensitive member 430 is transferred onto a transfer material P born on a transfer drum (transfer —material bearing member) 415 having dielectric body at a transfer nip $T_3$ by means of a transfer brush 401 and a color image is formed on the transfer material P by repeating such a transfer process by several times, the constant current control method according to the present invention can be applied to the transfer process. That is to say, in this case, the voltage applied matter 200 is constituted by the transfer brush 401. The toner image transferred to the transfer material P is fixed to the transfer material in a fixing device 441. In this way, the image formation is finished.

Figure 18:
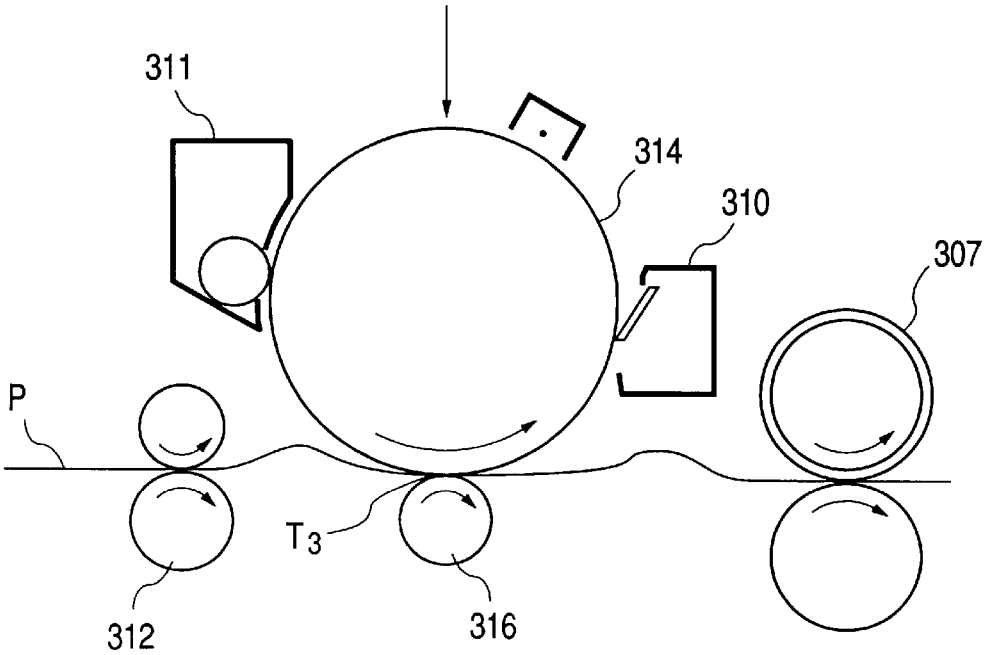

Further, in a mono-color image forming apparatus (as shown in FIG. 18) in which a toner image on a photosensitive member 311 is transferred onto a transfer material P while the transfer material P is being passed through a transfer nip $T_3$ between the photosensitive member 311 and a transfer roller 316, the constant current control method according to the present invention can be applied to the transfer process. That is to say, in this case, the voltage applied matter 200 is constituted by the transfer roller 316. The toner image transferred to the transfer material P is fixed to the transfer material in a fixing device 307. In this way, the image formation is finished.

Incidentally, in a relation between the —photosensitive member and the transfer brush or the transfer roller in the image forming apparatus shown in FIG. 17 or FIG. 18, since dark portion potential $V_D$ on the photosensitive member is always kept constant, the charge amount of the no toner existing portion can be known. To the contrary, in a relation between the intermediate transfer member (intermediate transfer belt 5*a*) and the secondary transfer roller 5*f* in the image forming apparatus as shown in FIG. 12, since background potential (potential of the no toner existing portion) on the intermediate transfer member is varied with variation of resistance of the intermediate transfer member and/or variation of first transfer current, the charge amount of the no toner existing portion cannot be known correctly. And, in the case where the full-color image is formed, since four color toners are superimposed at the toner existing portion at the maximum, it is difficult to previously set the optimum secondary transferring condition. Accordingly, it is preferable that the present invention is applied to the image forming apparatus using the intermediate transfer member as shown in FIG. 12.

Sixth Embodiment

Next, an embodiment in which the constant current control method according to the present invention is applied to the transfer device 5 will be fully explained. In this embodiment and other embodiments which will be described hereinafter, the voltage applied matter 200 is the secondary transfer roller 5*f*. Incidentally, FIG. 13 shows the transfer device 5 and means for controlling the transfer device in the image forming apparatus shown in FIG. 12.

Figure 13:
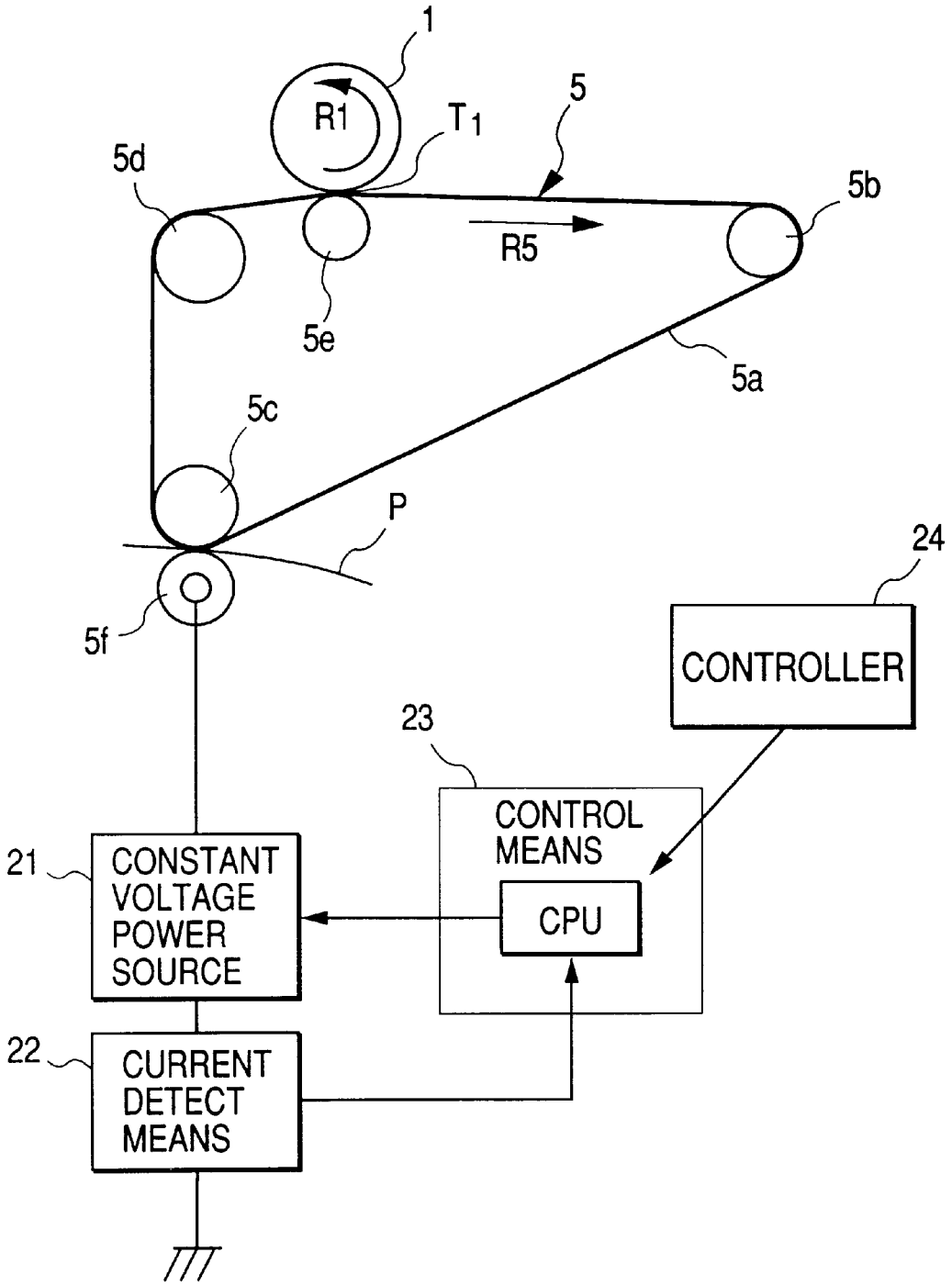
FIG. 13 is an explanatory view showing a transfer device and control therefor according to a sixth embodiment of the present invention.

As shown in FIG. 13, the secondary transfer roller (transfer means) 5*f* is connected to a constant voltage power source 21 for applying secondary transfer bias to the secondary transfer roller and a current detect means 22 for detecting the flowing current, and the power source 21 and the detect means 22 are connected to a CPU (control means) 23. When the detection signal from the current detect means 22 is inputted to the CPU 23, the CPU 23 controls the constant voltage power source 21 on the basis of the inputted signal so that the current becomes the predetermined value. According to this method, for example, complex control including both constant current and constant voltage can be performed with reduced cost. In the sixth embodiment, the target current value is changed in accordance with a width of the transfer material P in a direction perpendicular to the transfer material shifting direction (sheet pass width).

In order to always keep the transfer property in the secondary transferring constant, the charge amount (per unit area) given to the transfer material. P during the secondary transferring may always be kept constant. Since a length of the secondary transfer roller 5*f* in a longitudinal direction is greater than the sheet pass —width of a maximum transfer material P, at the secondary transfer nip $T_2$, the current from the secondary transfer roller 5*f* flows into a portion (sheet pass portion) where the transfer material P exists and a portion (sheet non-pass portion) where the transfer material P does not exist. However, since the current value which can actually be controlled is the sum of the current flowing through the sheet pass portion and the current flowing the sheet non-pass portion, if the sheet pass width is changed to change the ratio between the sheet pass portion and the sheet non-pass portion, the charge amount given to the transfer material P is also changed, thereby changing the transfer property. In consideration of the above, in the sixth embodiment, target current value is changed in accordance with the sheet pass width.

In the sixth embodiment, the intermediate transfer belt 5*a* is constituted by forming NBR (nitrile rubber) having volume resistance of $10^5$ Ω•cm or less, a thickness of 1 mm, a width of 230 mm and a peripheral length of 140 πmm as an endless cylinder and by coating a high resistance dielectric layer having a thickness of about 50 μm on the front surface of the endless cylinder. Further, the secondary transfer roller 5*f* is constituted by EPDM having a diameter of 18 mm, a width of 220 mm and resistance of $10^7$ to $10^8$ Ω. Information regarding the sheet pass width L of the transfer material P is sent from the controller 24 to the CPU 23 before image formation.

In the sixth embodiment, the target current value I (μA) is set to satisfy the following relation (2) when the sheet pass width is L (mm):

$$I=23-L/15 \quad (2)$$

Figure 15:
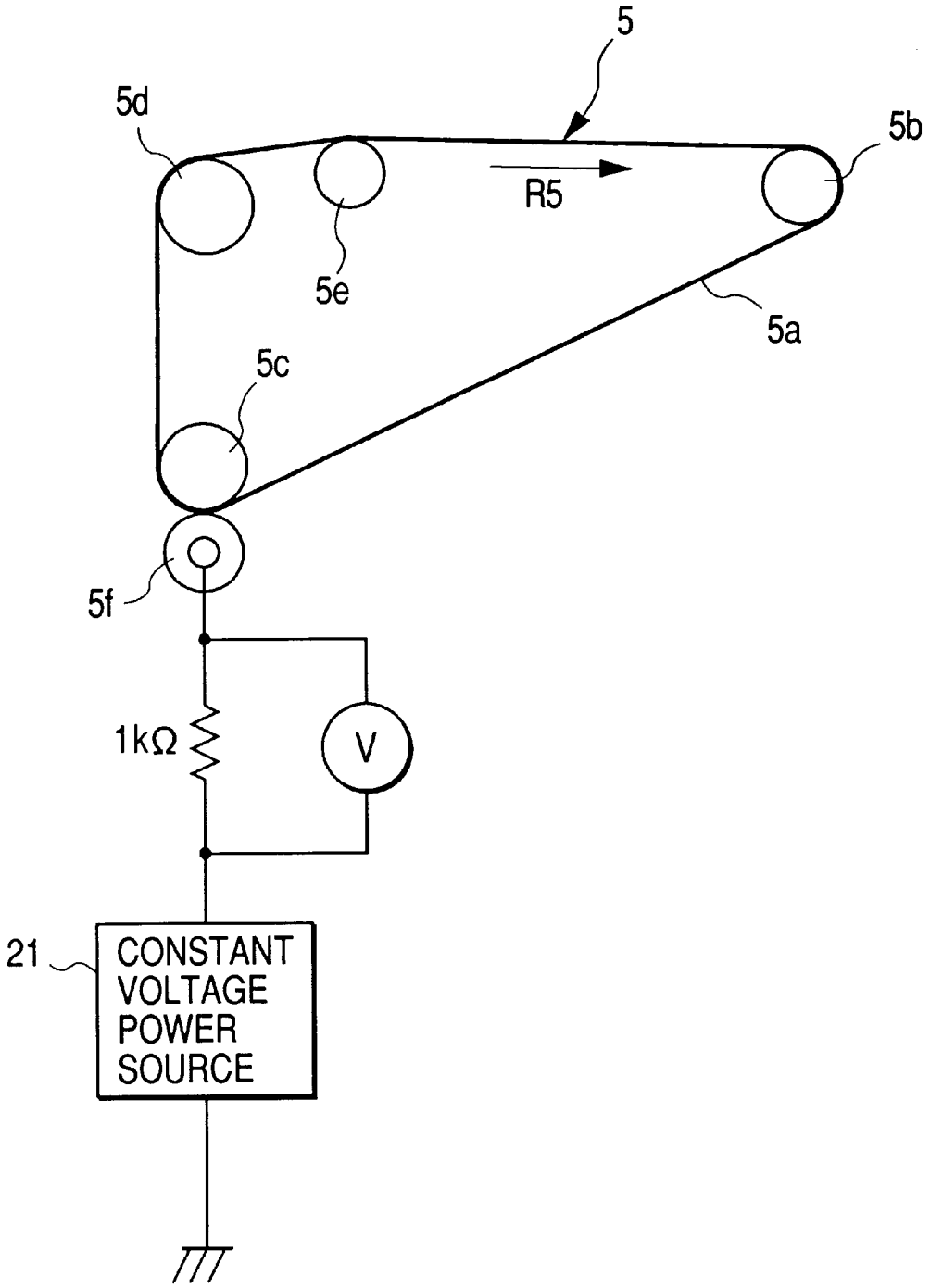
FIG. 15 is a view showing measurement of current applied to a secondary transfer roller.

During the secondary transferring, by effecting the constant current control by the CPU 23 and the constant voltage power source 21, the stable transfer property can be obtained regardless of the sheet pass width. Incidentally, the above equation (2) is derived from test results. In this case, as shown in FIG. 15, the current value is calculated by connecting resistance of 1 kΩ to the constant voltage power source 21 and by measuring voltage values on both ends of the resistance.

Figure 16:
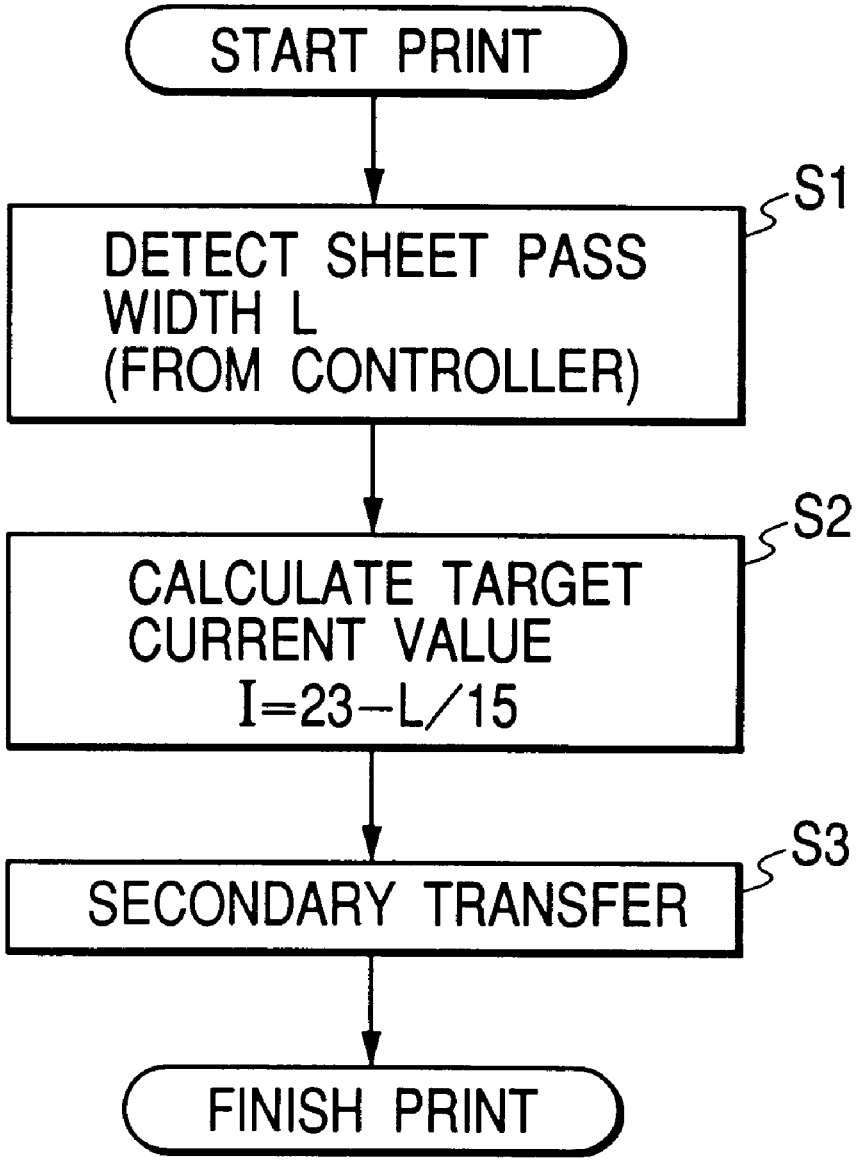
FIG. 16 is a flow chart showing an operation in the sixth embodiment.

Now, an operation of the sixth embodiment: will be described with reference to a flow chart shown in FIG. 16. After the print start, the sheet pass width L of the transfer material P is detected by the controller 24 (step Si). The target current value I is calculated in accordance with the sheet pass width (step S2), and the secondary transferring is effected on the basis of the calculated target current value (step S3).

In the sixth embodiment, while an example that the information regarding the sheet pass width L of the transfer material P is inputted from the controller 24 to the CPU 23 was explained, the present invention is not limited to such an example, but, for example, a size display mark may be provided on the sheet supply cassette 9 and the mark may be detected to detect the sheet pass width L, or, by detecting positions of side guides for regulating both lateral edges of a transfer material on a sheet manual insertion tray, the sheet pass width L may be detected.

Seventh Embodiment

In a seventh embodiment of the present invention, in addition to the arrangement of the sixth embodiment, the CPU 23 controls so that the voltage applied to the secondary transfer roller 5*f* is included within a predetermined range, and the range of the apply voltage is changed in accordance with the sheet pass width. Incidentally, the same explanation as that regarding the sixth embodiment will be omitted.

If the environmental condition is changed to high temperature/high humidity, since the resistance of the transfer material P is decreased in comparison with that in the normal temperature/normal humidity condition, during the secondary transferring, the current flows into parts contacted with the transfer material (such as the sheet supply roller 10 for conveying the transfer material P, convey belt 7 and guide members 11, 12) through the transfer material P, with the result that the desired charges are not given to the transfer material P, thereby causing poor transferring. Further, under the low temperature/low humidity condition, since the resistances of the transfer material P, secondary transfer roller 5*f* and intermediate transfer belt 5*a* are increased in comparison with those in the normal temperature/normal humidity condition, the voltage required to flow the desired current is also increased, thereby causing current leak.

To avoid this, in the sixth embodiment, there are provided an upper limit value and a lower limit value of the voltage applied to the secondary transfer roller 5*f*. By controlling such values by the CPU 23, if the transfer material P has low resistance, the constant current control according to the present invention is automatically switched to constant voltage control not to exceed the upper and lower limit values, thereby preventing the poor transferring. And, under the low temperature/low humidity condition, even if the transfer material P has high resistance, by automatically switching from constant current control according to the present invention to the constant voltage control, a voltage limiter of the constant voltage power source is operated to prevent the current leak. Further, in the seventh embodiment, in order to prevent the change in the transfer property due to change in the sheet pass width L, the lower limit value of the apply voltage is changed in accordance with the sheet pass width L.

In the seventh embodiment, the intermediate transfer belt 5*a* is constituted by forming NBR (nitrile rubber) having volume resistance of $10^5$ Ω•cm or less, a thickness of 1 mm, a width of 230 mm and a peripheral length of 140 πmm as an endless cylinder and by coating a high resistance dielectric layer having a thickness of about 50 μm on the front surface of the endless cylinder. Further, the secondary transfer roller 5*f* is constituted by EPDM having a diameter of 18 mm, a width of 220 mm and resistance of $10^7$ to $10^8$ Ω. Information regarding the sheet pass width L of the transfer material P is sent from the controller 24 to the CPU 23 before image formation.

In the seventh embodiment, the target current value I (μA) is set to satisfy the following relation (3) when the sheet pass width is L (mm):

$$I=23-L/15 \quad (3)$$

And, the lower limit value $V_L$ (V) and the upper limit value $V_H$ (V) of the apply voltage are selected as follows, respectively:

$$V_L=1800-1.5\times L$$

$$V_H=3800$$

During the secondary transferring, by effecting the constant current control, even under the special conditions such as the low resistance of the transfer material P or the low temperature/low humidity condition, the stable transfer property can be obtained regardless of the sheet pass width. Incidentally, the above equations regarding the values $V_L$, $V_H$ are derived from test results.

Eighth Embodiment

In an eighth embodiment of the present invention, the target current value is changed in accordance with a first surface and a second surface of the transfer material P in a both-face image forming mode. Incidentally, the same explanation as those regarding the sixth and seventh embodiments will be omitted, and only characteristic portions of the eighth embodiment will be explained.

In a case where images are formed on both surfaces of the transfer material P, when the toner image is transferred onto the second surface of the transfer material P, the transfer material P has been passed through the fixing device 8 once during the image formation on the first surface thereof to be heated by the fixing device to increase the resistance value thereof. Thus, the ratio between the current flowing through the sheet pass portion and the current flowing through the sheet non-pass portion is changed in comparison with the ratio regarding the first surface of the transfer material. Accordingly, if the same current as the current regarding the first surface is used, more current is flowing into the sheet non-pass portion, with the result that the charge cannot be given to the transfer material P adequately, thereby causing the poor transferring. To prevent this, in the eighth embodiment, by changing the current value regarding the second surface from the current value regarding the first surface, the constant current control is effected during the secondary transferring.

Similar to the sixth and seventh embodiments, in the eighth embodiment, the intermediate transfer belt 5*a* is constituted by forming NBR (nitrile rubber) having volume resistance of $10^5$ Ω•cm or less, a thickness of 1 mm, a width of 230 mm and a peripheral length of 140 πmm as an endless cylinder and by coating a high resistance dielectric layer having a thickness of about 50 μm on the front surface of the endless cylinder. Further, the secondary transfer roller 5*f* is constituted by EPDM having a diameter of 18 mm, a width of 220 mm and resistance of 101 to $10^8$ Ω. By selecting the target current value regarding the first surface to 9 μA and the target current value regarding the second surface to 11 μA on the basis of the test results, the stable transfer property can be obtained regarding both the first and second surfaces of the transfer material. Further, when the CPU 23 controls so that the voltage applied to the secondary transfer roller 5*f* is included within the predetermined range to change the range of the apply voltage in accordance with the first and second surfaces, more stable transfer property can be obtained.

Ninth Embodiment

In a ninth embodiment of the present invention, a resistance measuring means for measuring the resistance of the transfer material P is provided, and the target current value is changed in accordance with the resistance value of the transfer material P. Incidentally, the same explanation as those regarding the sixth to eighth embodiments will be omitted, and only characteristic portions of the ninth embodiment will be explained.

As mentioned above, in order to keep the transfer property, the current flowing through the transfer material P may be kept constant. However, if the resistance of the transfer material P is changed, since the ratio between the current flowing through the sheet pass portion and the current flowing through the sheet non-pass portion is changed, in the constant current control according to the present invention, the charge amount actually given to the transfer material P is also changed.

Figure 14:
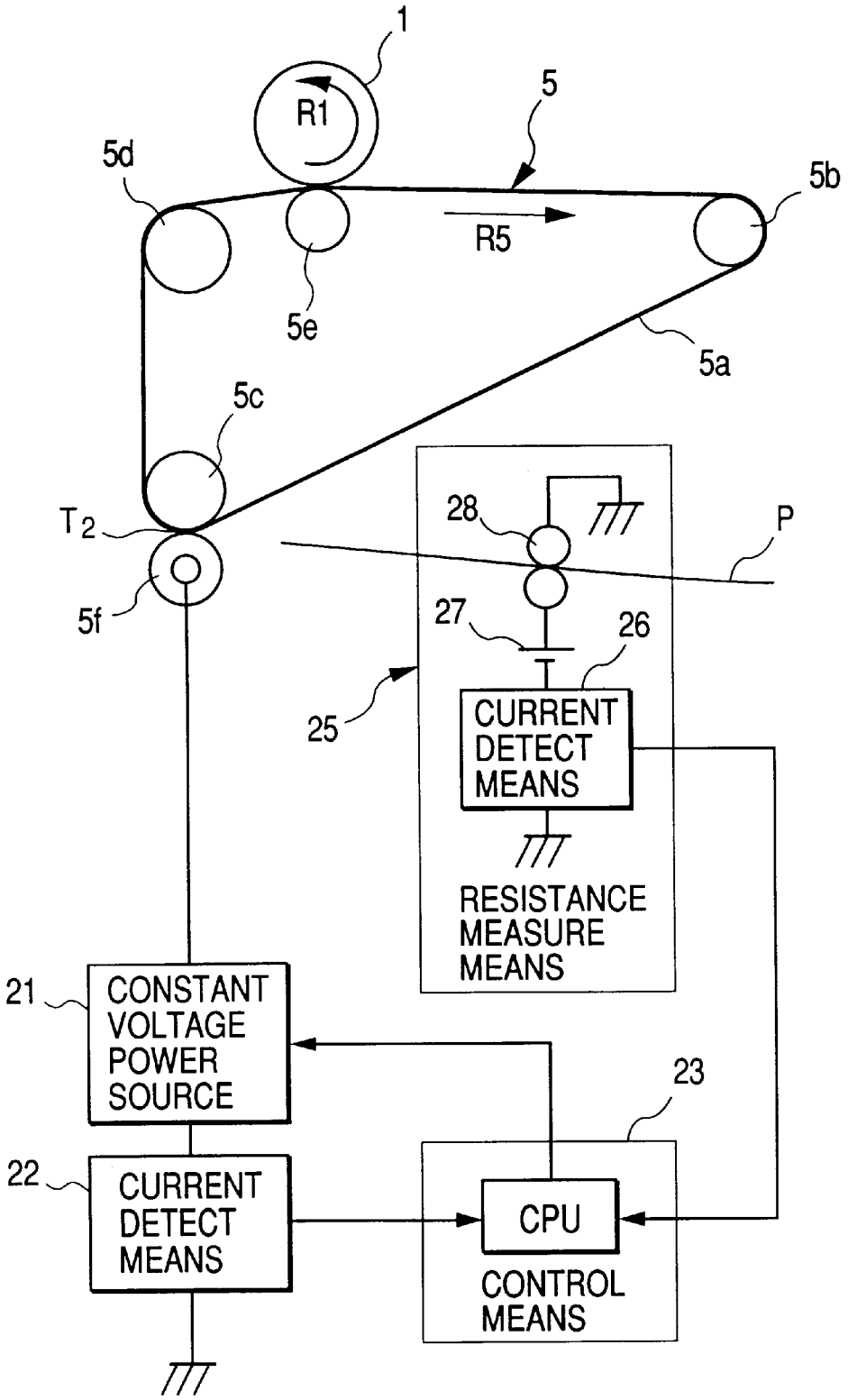
FIG. 14 is an explanatory view showing a transfer device and control therefor according to a ninth embodiment of the present invention.

To avoid this, in the ninth embodiment, the resistance of the transfer material P is measured, and, by changing the target current value in accordance with the resistance value of the transfer material, the constant current control is effected during the secondary transferring. Although the resistance measuring means for measuring the resistance of the transfer material P may be a known measuring means, in the ninth embodiment, as shown in FIG. 14, a resistance measuring means (resistance detecting means) 25 is disposed between the sheet supply roller 10 and the secondary transfer nip $T_2$. The resistance measuring means 25 comprises a pair of resistance measuring rollers 28 for pinching the transfer material P from both sides, a power source 27 for applying voltage to the paired rollers 28, and a current detect means 26 for detecting the current and is connected to the CPU 23. The voltage applied to the paired rollers (contact members) 28 and the current flowing in this case are inputted to the CPU 23, and the resistance of the transfer material P is calculated on the basis of the inputted data. Since the resistance value of the transfer material P may be measured before the secondary transferring, the resistance measuring means 25 may be disposed between the sheet supply cassette 9 and the sheet supply roller 10. Further, predetermined current may be applied to the resistance measuring roller pair 28 to measure the voltage between the rollers, thereby calculating the resistance of the transfer material P.

Similar to the sixth to eighth embodiments, in the ninth embodiment, the intermediate transfer belt 5*a* is constituted by forming NBR (nitrile rubber) having volume resistance of $10^5$ Ω•cm or less, a thickness of 1 mm, a width of 230 mm and a peripheral length of 140 πmm as an endless cylinder and by coating a high resistance dielectric layer having a thickness of about 50 μm on the front surface of the endless cylinder. Further, the secondary transfer roller 5*f* is constituted by EPDM having a diameter of 18 mm, a width of 220 mm and resistance of $10^7$ to $10^8$ Ω. When it is assumed that the resistance of the transfer material P is R (Ω), the target current value I (A) is set as follows:

$$I=1.5\times\log R-3$$

Incidentally, the above equation is derived from test results, and the actual resistance R of the transfer material P is measured by using a measuring device "Hiresta" (probe HR100) manufactured by Mitsubishi Yuka Co., Ltd. under a measuring condition of apply voltage of 100 V and measuring time of 30 seconds. As a result, the stable transfer property can be obtained regarding both the first and second surfaces of the transfer material. Further, when the CPU 23 controls so that the voltage applied to the secondary transfer roller 5*f* is included within the predetermined range to change the range of the apply voltage in accordance with the resistance of the transfer material P, more stable transfer property can be obtained.

Tenth Embodiment

In a tenth embodiment of the present invention, there is provided a speed switching means in which the process speed during the secondary transferring can be changed between at least two values so that the target current value is changed in accordance with the selected process speed. Incidentally, the same explanation as those regarding the sixth to ninth embodiments will be omitted, and only characteristic portions of the tenth embodiment will be explained.

When a thick sheet or an OHP (overhead projecting sheet) as a light permeable resin sheet is used as the transfer material P, in order to improve fixing ability of the non-fixed toner on the transfer material P, a fixing speed is generally delayed. In this case, when a distance x between the secondary transfer roller 5*f*and the fixing device 8 is smaller than the length $L_P$ of the maximum transfer material P in the conveying direction, the tip and trail end portions of the transfer material P are pinched by the fixing device 8 and the secondary transfer nip $T_2$ simultaneously. In this case, when the fixing speed is delayed or reduced, it is preferable that the secondary transferring speed is also reduced accordingly. When the process speed during the secondary transferring is changed in accordance with the fixing speed, if the same current is used in the constant current control, the charge amount (per unit area) given to the transfer material P is also changed, thereby changing the transfer property. To avoid this, in the tenth embodiment, the constant control is effected during the secondary transferring by changing the target current value in accordance with the process speed during the secondary transferring.

Similar to the sixth to ninth embodiments, in the tenth embodiment, the intermediate transfer belt 5*a* is constituted by forming NBR (nitrile rubber) having volume resistance of $10^5$ Ω•cm or less, a thickness of 1 mm, a width of 230 mm and a peripheral length of 140 πmm as an endless cylinder and by coating a high resistance dielectric layer having a thickness of about 50 μm on the front surface of the endless cylinder. Further, the secondary transfer roller 5*f* is constituted by EPDM having a diameter of 18 mm, a width of 220 mm and resistance of $10^7$ to $10^8$ Ω. The process speed can be switched between 117 mm/sec, 58 mm/sec and 39 mm/sec. By selecting the target current value to 9 μA, 3.5 μA and 2.5 μA in accordance with 117 mm/sec, 58 mm/sec and 39 mm/sec (process speed), respectively, even when the process speed is changed, the stable transfer property can be obtained. Further, when the CPU 23 controls so that the voltage applied to the secondary transfer roller 5*f* is included within the predetermined range to change the range of the apply voltage in accordance with the process speed, more stable transfer property can be obtained.

Eleventh Embodiment

In an eleventh embodiment of the present invention, the target current value is changed in accordance with a mono-color mode in which a mono-color image is formed on the transfer material P and a full-color mode in which a full-color image is formed on the transfer material P. Incidentally, the same explanation as those regarding the sixth to tenth embodiments will be omitted, and only characteristic portions of the eleventh embodiment will be explained.

In the mono-color mode, since the toner image on the photosensitive drum 1 is first-transferred onto the intermediate transfer belt 5*a* and immediately after the toner image is secondary-transferred onto the transfer material P, the intermediate transfer belt 5*a* is rotated only by one revolution from the first transferring to the secondary transferring, and the charges from the photosensitive drum 1 is given to the toner image on the intermediate transfer belt 5*a* only by one time. To the contrary, in the full-color mode, since the toner images formed on the photosensitive drum 1 for respective colors are successively first-transferred onto the intermediate transfer belt 5*a* in a superimposed fashion and thereafter the toner images are secondary-transferred onto the transfer material P collectively, the intermediate transfer belt 5*a* is rotated at least by four revolutions from the first transferring to the secondary transferring. Thus, since the first color toner image is passed through the first transfer nip $T_1$ at least by three times other than the first transferring, the charge amount of the first color toner image differs from that of the fourth color toner image which is not passed through the first transfer nip $T_1$ other than the first transferring. Accordingly, the charge amount of toner in the mono-color mode differs from the charge amount of toner in the full-color mode immediately before the secondary transferring, with the result that, even is the same transfer current is used, the transfer property is changed.

To avoid this, in the eleventh embodiment, the constant current control is effected during the secondary transferring by changing the target current value in accordance with the mono-color mode and the full-color mode.

Similar to the sixth to tenth embodiments, in the eleventh embodiment, the intermediate transfer belt 5*a*is constituted by forming NBR (nitrile rubber) having volume resistance of $10^5$ Ω•cm or less, a thickness of 1 mm, a width of 230 mm and a peripheral length of 140 πmm as an endless cylinder and by coating a high resistance dielectric layer having a thickness of about 50 μm on the front surface of the endless cylinder. Further, the secondary transfer roller 5*f* is constituted by EPDM having a diameter of 18 mm, a width of 220 mm and resistance of $10^7$ to $10^8$ Ω. And, by selecting the target current value to 5 μA in the mono-color mode and to 9 μA in the full-color mode, the stable transfer property can be obtained in both the mono-color mode and the full-color mode. Further, when the CPU 23 controls so that the voltage applied to the secondary transfer roller 5*f* is included within the predetermined range to change the range of the apply voltage in accordance with mono-color mode and the full-color mode, more stable transfer property can be obtained.

In the above-mentioned embodiments, while an example that the intermediate transfer belt 5*a* is used as the intermediate transfer member in the image forming apparatus was explained, the intermediate transfer member in the present invention is not limited to the intermediate transfer belt, but, for example, an intermediate transfer drum can be used. Also in this case, substantially the same effect can be expected.

As apparent from the foregoing explanation, according to the present invention, since the plurality of voltage change widths are previously prepared and the constant voltage power source is controlled by switching the voltage change width in accordance with the difference amount current value between the target current value and the detected current value, even if the load is abruptly changed, the stable constant current control in which the current can quickly be converged to the target current value can always be effected. Further, by changing the voltage change width in accordance with the difference amount current value between the target current value and the detected current value, the effect can be more improved.

Further, by giving the predetermined width to the target current value, the noise can be eliminated without making the apparatus expensive, thereby achieving the stable constant current control. In addition, by changing the voltage change amount in accordance with the increase/decrease of the voltage, the same effect can be achieved. Furthermore, by starting the control after the voltage is risen up to the predetermined level, the same effect can be achieved without erroneous control.

According to the present invention, since the control means changes the target current value of the current flowing through the transfer means in accordance with the condition of the transfer material (for example, the sheet pass width of the transfer material, or first surface/second surface of the transfer material, or resistance of the transfer material, or process speed, or mono-color mode/full-color mode), the proper current can be applied to the sheet pass portion between the intermediate transfer member and the secondary transfer member (i.e., to the transfer material subjected to the secondary transferring), thereby effecting the good secondary transferring.

What is claimed is:

1. A control method for controlling an output of a constant voltage power source so that a current value detected by a current detect means becomes a predetermined current value, by applying a voltage from said constant voltage power source to a voltage applied member, by detecting current flowing in said voltage applied member by said current detect means and by changing the voltage applied to said voltage applied member every certain voltage width, characterized by that the voltage width can be varied with a difference between the predetermined current value and the current value detected by said current detect means.

2. A control method according to claim 1, wherein the voltage width used when the current value detected by said current detect means is smaller than the predetermined current value differs from the voltage width used when the current value detected by said current detect means is larger than the predetermined current value.

3. A control method according to claim 1, wherein the predetermined current value has a predetermined width.

4. A control method according to one of claims 1 to 3, wherein, when a predetermined time period is elapsed after the voltage is applied to said voltage applied member, detection of said current detect means is started.

5. A control method for controlling an output of a constant voltage power source so that a current value detected by a current detect means becomes a predetermined current value, by applying a voltage from said constant voltage power source to a voltage applied member, by detecting current flowing in said voltage applied member by said current detect means and by changing the voltage applied to said voltage applied member every certain voltage width, characterized by that the voltage width used when the current value detected by said current detect means is smaller than the predetermined current value differs from the voltage width used when the current value detected by said current detect means is larger than the predetermined current value.

6. A control method according to claim 5, wherein the voltage width can be varied with a difference between the predetermined current value and the current value detected by said current detect means.

7. A control method according to claim 5, wherein the predetermined current value has a predetermined width.

8. A control method according to any one of claims 5 to 7, wherein, when a predetermined time period is elapsed after the voltage is applied to said voltage applied member, detection of said current detect means is started.

9. A control method for controlling an output of a constant voltage power source so that a current value detected by a current detect means becomes a predetermined current value, by applying a voltage from said constant voltage power source to a voltage applied member, by detecting current flowing in said voltage applied member by said current detect means and by changing the voltage applied to said voltage applied member every certain voltage width, characterized by that the voltage width can be varied with the current value detected by said current detect means.

10. A control method according to claim 9, wherein the voltage width can be varied with a difference between the predetermined current value and the current value detected by said current detect means.

11. A control method according to claim 9, wherein the voltage width used when the current value detected by said current detect means is smaller than the predetermined current value differs from the voltage width used when the current value detected by said current detect means is larger than the predetermined current value.

12. A control method according to claim 9, wherein the predetermined current value has a predetermined width.

13. A control method according to any one of claims 9 to 12, wherein, when a predetermined time period is elapsed after the voltage is applied to said voltage applied member, detection of said current detect means is started.

14. An image forming apparatus comprising:

an image bearing member for bearing an image;

an intermediate transfer member onto which the image on said image bearing member is electrostatically transferred;

a transfer means for electrostatically transferring the image on said intermediate transfer member to a transfer material;

a constant voltage power source;

a current detect means for detecting current flowing through said transfer means when voltage is applied from said constant voltage power source to said transfer means; and a control means for controlling of output of said constant voltage power source so that the current value detected by said current detect means becomes a predetermined current value, by changing the voltage applied to said transfer means every certain voltage width;

characterized by that the voltage width can be varied with a difference between the predetermined current value and the current value detected by said current detect means.

15. An image forming apparatus according to claim 14, wherein the predetermined current value can be varied with a length of the transfer material in a direction perpendicular to a transfer material shifting direction.

16. An image forming apparatus according to claim 15, further comprising a transfer material detect means for detecting the length of the transfer material in the direction perpendicular to the transfer material shifting direction, and the predetermined current value can be varied on the basis of a detected result from said transfer material detect means.

17. An image forming apparatus according to claim 14, wherein, after the image on said intermediate transfer member is transferred to a first surface of the transfer material, the image on said intermediate transfer member can be transferred to a second surface of the transfer material opposite to the first; surface, the predetermined current value can be varied on the basis of the first or second surface of the transfer material to which the image on said intermediate transfer member is transferred by said transfer means.

18. An image forming apparatus according to claim 17, further comprising a judge means for judging whether a surface of the transfer material to which the image on said intermediate transfer member is transferred by said transfer means is the first surface or the second surface, and the predetermined current value can be varied on the basis of a judged result from said judge means.

19. An image forming apparatus according to claim 14, further comprising a contact member to which voltage is applied while contacting with the transfer material to pinch the transfer material before the image on said intermediate transfer member is transferred to the transfer material by said transfer means, and the predetermined current value can be varied on the basis of a value of current flowing through said contact member when the voltage is applied to said contact member.

20. An image forming apparatus according to claim 19, wherein said contact member has a pair of rollers.

21. An image forming apparatus according to claim 14, wherein said intermediate transfer member is rotatable, and the predetermined current value can be varied on the basis of a rotational speed of said intermediate transfer member.

22. An image forming apparatus according to claim 21, wherein the rotational speed of said intermediate transfer member can be switched between a first speed and a second speed slower than said first speed.

23. An image forming apparatus according to claim 22, wherein, when the transfer material is a resin sheet, the rotational speed of said intermediate transfer member is switched to the second speed.

24. An image forming apparatus according to claim 22, wherein, when a weight of the transfer material is 105 $g/m^2$ or more, the rotational speed of said intermediate transfer member is switched to the second speed.

25. An image forming apparatus according to one of claims 22 to 24, further comprising a rotatable fixing means for fixing the image transferred to the transfer material by said transfer means, and a rotational speed of said fixing means can be switched between said first speed and said second speed.

26. An image forming apparatus according to claim 14, wherein the image forming apparatus can be switched between a mono-color image forming mode in which a mono-color toner image on said image bearing member is electrostatically transferred onto said intermediate transfer member and the mono-color image on said intermediate transfer member is transferred onto the transfer material, and a multi-color image forming mode in which plural color toner images on said image bearing member are electrostatically transferred onto said intermediate transfer member successively in a superimposed fashion and the plural color toner images on said intermediate transfer member are transferred onto the transfer material, and the predetermined current value in said mono-color image forming mode differs from the predetermined current value in said multi-color image forming mode.

27. An image forming apparatus according to claim 14, wherein said transfer means is contacted with the transfer material while the image on said intermediate transfer member is being transferred onto the transfer material.

28. An image forming apparatus according to claim 27, wherein said transfer means has a roller.

29. An image forming apparatus according to claim 14, wherein the predetermined current value has a predetermined width.

30. An image forming apparatus according to claim 14, wherein the voltage width used when the current value detected by said current detect means is smaller than the predetermined current value differs from the voltage width used when the current value detected by said current detect means is larger than the predetermined current value.

31. An image forming apparatus according to claim 29 or 30, wherein, when a predetermined time period has elapsed after the voltage is applied to said voltage applied member, detection of said current detect means is started.

32. An image forming apparatus according to claim 14, wherein, while said transfer means transfers the image on said intermediate transfer member to the transfer material, said control means controls output of said constant voltage power source so that the current value detected by said current detect means becomes the predetermined current value.

33. An image forming apparatus according to claim 14, wherein said image forming apparatus reiterates a process of transferring the image on said image bearing member to said intermediate transfer member to form a multicolor image on said intermediate transfer member, and wherein said transfer means transfers said multicolor image on said intermediate transfer member to the transfer material.

34. An image forming apparatus comprising:

an image bearing member for bearing an image;

an intermediate transfer member onto which the image on said image bearing member is electrostatically transferred;

a transfer means for electrostatically transferring the image on said intermediate transfer member to a transfer material;

a constant voltage power source;

a current detect means for detecting current flowing through said transfer means when voltage is applied from said constant voltage power source to said transfer means; and a control means for controlling of output: of said constant voltage power source so that the current value detected by said current detect means becomes a predetermined current value, by changing the voltage applied to said transfer means every certain voltage width;

characterized by that the voltage width used when the current value detected by said current detect means is smaller than the predetermined current value differs from the voltage width used when the current value detected by said current detect means is larger than the predetermined current value.

35. An image forming apparatus according to claim 34, wherein the predetermined current value can be varied with a length of the transfer material in a direction perpendicular to a transfer material shifting direction.

36. An image forming apparatus according to claim 35, further comprising a transfer material detect means for detecting the length of the transfer material in the direction perpendicular to the transfer material shifting direction, and wherein the predetermined current value can be varied on the basis of a detected result from said transfer material detect means.

37. An image forming apparatus according to claim 34, wherein, after the image on said intermediate transfer member is transferred to a first surface of the transfer material, the image on said intermediate transfer member can be transferred to a second surface of the transfer material opposite to the first surface, the predetermined current value can be varied on the basis of the first or second surface of the transfer material to which the image on said intermediate transfer member is transferred by said transfer means.

38. An image forming apparatus according to claim 37, further comprising a judge means for judging whether a surface of the transfer material to which the image on said intermediate transfer member is transferred by said transfer means is the first surface or the second surface, and wherein the predetermined current value can be varied on the basis of a judged result from said judge means.

39. An image forming apparatus according to claim 34, further comprising a contact member to which voltage is applied while contacting with the transfer material to pinch the transfer material before the image on said intermediate transfer member is transferred to the transfer material by said transfer means, and the predetermined current value can be varied on the basis of a value of current flowing through said contact member when the voltage is applied to said contact member.

40. An image forming apparatus according to claim 39, wherein said contact member has a pair of rollers.

41. An image forming apparatus according to claim 34, wherein said intermediate transfer member is rotatable, and the predetermined current value can be varied on the basis of a rotational speed of said intermediate transfer member.

42. An image forming apparatus according to claim 41, wherein the rotational speed of said intermediate transfer member can be switched between a first speed and a second speed slower than said first speed.

43. An image forming apparatus according to claim 42, wherein, when the transfer material is a resin sheet, the rotational speed of said intermediate transfer member is switched to the second speed.

44. An image forming apparatus according to claim 42, wherein, when a weight of the transfer material is 105 $g/m^2$ or more, the rotational speed of said intermediate transfer member is switched to the second speed.

45. An image forming apparatus according to one of claims 42 to 44, further comprising a rotatable fixing means for fixing the image transferred to the transfer material by said transfer means, and wherein a rotational speed of said fixing means can be switched between said first speed and said second speed.

46. An image forming apparatus according to claim 34, wherein the image forming apparatus can be switched between a mono-color image forming mode in which a mono-color toner image on said image bearing member is electrostatically transferred onto said intermediate transfer member and the mono-color image on said intermediate transfer member is transferred onto the transfer material, and a multi-color image forming mode in which plural color toner images on said image bearing member are electrostatically transferred onto said intermediate transfer member successively in a superimposed fashion and the plural color toner images on said intermediate transfer member are transferred onto the transfer material, and the predetermined current value in said mono-color image forming mode differs from the predetermined current value in said multi-color image forming mode.

47. An image forming apparatus according to claim 34, wherein said transfer means is contacted with the transfer material while the image on said intermediate transfer member is being transferred onto the transfer material.

48. An image forming apparatus according to claim 47, wherein said transfer means has a roller.

49. An image forming apparatus according to claim 34, wherein the voltage width is changed in accordance with a difference between the predetermined current value and the current value detected by said current detect means.

50. An image forming apparatus according to claim 34, wherein the predetermined current value has a predetermined width.

51. An image forming apparatus according to claim 49 or 50, wherein, when a predetermined time period has elapsed after the voltage is applied to said voltage applied member, detection of said current detect means is started.

52. An image forming apparatus according to claim 34, wherein, while said transfer means transfers the image on said intermediate transfer member to the transfer material, said control means controls output of said constant voltage power source so that the current value detected by said current detect means becomes the predetermined current value.

53. An image forming apparatus according to claim 34, wherein said image forming apparatus reiterates a process of transferring the image on said image bearing member to said intermediate transfer member to form a multicolor image on said intermediate transfer member, and wherein said transfer means transfers said multicolor image on said intermediate transfer member to the transfer material.

54. An image forming apparatus comprising:

an image bearing member for bearing an image;

an intermediate transfer member onto which the image on said image bearing member is electrostatically transferred;

a transfer means for electrostatically transferring the image on said intermediate transfer member to a transfer material;

a constant voltage power source;

a current detect means for detecting current flowing through said transfer means when voltage is applied from said constant voltage power source to said transfer means; and a control means for controlling of output of said constant voltage power source so that the current value detected by said current detect means becomes to a predetermined current value, by changing the voltage applied to said transfer means every certain voltage width;

characterized by that the voltage width can be varied on the basis of the current value detected by said current detect means.

55. An image forming apparatus according to claim 54, wherein the predetermined current value can be varied with a length of the transfer material in a direction perpendicular to a transfer material shifting direction.

56. An image forming apparatus according to claim 55, further comprising a transfer material detect means for detecting the length of the transfer material in the direction perpendicular to the transfer material shifting direction, and wherein the predetermined current value can be varied on the basis of a detected result from said transfer material detect means.

57. An image forming apparatus according to claim 54, wherein, after the image on said intermediate transfer member is transferred to a first surface of the transfer material, the image on said intermediate transfer member can be transferred to a second surface of the transfer material opposite to the first surface, the predetermined current value can be varied on the basis of the first or second surface of the transfer material to which the image on said intermediate transfer member is transferred by said transfer means.

58. An image forming apparatus according to claim 57, further comprising a judge means for judging whether a surface of the transfer material to which the image on said intermediate transfer member is transferred by said transfer means is the first surface or the second surface, and wherein the predetermined current value can be varied on the basis of FL judged result from said judge means.

59. An image forming apparatus according to claim 54, further comprising a contact member to which voltage is applied while contacting with the transfer material to pinch the transfer material before the image on said intermediate transfer member is transferred to the transfer material by said transfer means, and the predetermined current value can be varied on the basis of a value of current flowing through said contact member when the voltage is applied to said contact member.

60. An image forming apparatus according to claim 59, wherein said contact member has a pair of rollers.

61. An image forming apparatus according to claim 54, wherein said intermediate transfer member is rotatable, and the predetermined current value can be varied on the basis of a rotational speed of said intermediate transfer member.

62. An image forming apparatus according to claim 61, wherein the rotational speed of said intermediate transfer member can be switched between a first speed and a second speed slower than said first speed.

63. An image forming apparatus according to claim 62, wherein, when the transfer material is a resin sheet, the rotational speed of said intermediate transfer member is switched to the second speed.

64. An image forming apparatus according to claim 62, wherein, when a weight of the transfer material is 105 $g/m^2$ or more, the rotational speed of said intermediate transfer member is switched to the second speed.

65. An image forming apparatus according to one of claims 62 to 64, further comprising a rotatable fixing means for fixing the image transferred to the transfer material by said transfer means, and wherein a rotational speed of said fixing means can be switched between said first speed and said second speed.

66. An image forming apparatus according to claim 54, wherein the image forming apparatus can be switched between a mono-color image forming mode in which a mono-color toner image on said image bearing member is electrostatically transferred onto said intermediate transfer member and the mono-color image on said intermediate transfer member is transferred onto the transfer material and a multi-color image forming mode in which plural color toner images on said image bearing member are electrostatically transferred onto said intermediate transfer member successively in a superimposed fashion and the plural color toner images on said intermediate transfer member are transferred onto the transfer material, and the predetermined current value in said mono-color image forming mode differs from the predetermined current value in said multi-color image forming mode.

67. An image forming apparatus according to claim 54, wherein said transfer means is contacted with the transfer material while the image on said intermediate transfer member is being transferred onto the transfer material.

68. An image forming apparatus according to claim 67, wherein said transfer means has a roller.

69. An image forming apparatus according to claim 54, wherein the voltage width is changed in accordance with a difference between the predetermined current value and the current value detected by said current detect means.

70. An image forming apparatus according to claim 54, wherein the voltage width used when the current value detected by said current detect means is smaller than the predetermined current value differs from the voltage width used when the current value detected by said current detect means is smaller than the predetermined current value.

71. An image forming apparatus according to claim 54, wherein the predetermined current value has a predetermined width.

72. An image forming apparatus according to claim 69 to 71, wherein, when a predetermined time period is elapsed after the voltage is applied to said voltage applied member, detection of said current detect means is started.

73. An image forming apparatus according to claim 54, wherein, while said transfer means transfers the image on said intermediate transfer member to the transfer material, said control means controls output of said constant voltage power source so that the current value detected by said current detect means becomes the predetermined current value.

74. An image forming apparatus according to claim 54, wherein said image forming apparatus reiterates a process of transferring the image on said image bearing member to said intermediate transfer member to form a multicolor image on said intermediate transfer member, and wherein said transfer means transfers said multicolor image on said intermediate transfer member to the transfer material.

75. An image forming apparatus comprising:

an image bearing member for bearing an image;

a transfer means for electrostatically transferring the image on said image bearing member to a transfer material;

a constant voltage power source;

a current detect means for detecting current flowing through said transfer means when voltage is applied from said constant voltage power source to said transfer means; and a control means for controlling of output of said constant voltage power source so that the current value detected by said current detect means becomes a predetermined current value, by changing the voltage applied to said transfer means every certain voltage width;

characterized by that the voltage width can be varied on the basis of the current value detected by said current detect means.

76. An image forming apparatus according to claim 75, wherein the predetermined current value can be varied with a length of the transfer material in a direction perpendicular to a transfer material shifting direction.

77. An image forming apparatus according to claim 76, further comprising a transfer material detect means for detecting the length of the transfer material in the direction perpendicular to the transfer material shifting direction, and wherein the predetermined current value can be varied on the basis of a detected result from said transfer material detect means.

78. An image forming apparatus according to claim 75, wherein, after the image on said image bearing member is transferred to a first surface of the transfer material, the image on said image bearing member can be transferred to a second surface of the transfer material opposite to the first surface, the predetermined current value can be varied on the basis of the first or second surface of the transfer material to which the image on said image bearing member is transferred by said transfer means.

79. An image forming apparatus according to claim 78, further comprising a judge means for judging whether a surface of the transfer material to which the image on said image bearing member is transferred by said transfer means is the first surface or the second surface, and wherein the predetermined current value can be varied on the basis of a judged result from said judge means.

80. An image forming apparatus according to claim 75, further comprising a contact member to which voltage is applied while contacting with the transfer material to pinch the transfer material before the image on said image bearing member is transferred to the transfer material by said transfer means, and wherein the predetermined current value can be varied on the basis of a value of current flowing through said contact member when the voltage is applied to said contact member.

81. An image forming apparatus according to claim 80, wherein said contact member has a pair of rollers.

82. An image forming apparatus according to claim 75, wherein said image bearing member is rotatable, and the predetermined current value can be varied on the basis of a rotational speed of said image bearing member.

83. An image forming apparatus according to claim 82, wherein the rotational speed of said image bearing member can be switched between a first speed and a second speed slower than said first speed.

84. An image forming apparatus according to claim 83, wherein, when the transfer material is a resin sheet, the rotational speed of said image bearing member is switched to the second speed.

85. An image forming apparatus according to claim 83, wherein, when a weight of the transfer material is 105 $g/m^2$ or more, the rotational speed of said image bearing member is switched to the second speed.

86. An image forming apparatus according to one of claims 83 to 85, further comprising a rotatable fixing means for fixing the image transferred to the transfer material by said transfer means, and wherein a rotational speed of said fixing means can be switched between said first speed and said second speed.

87. An image forming apparatus according to claim 75, wherein the image forming apparatus can be switched between a mono-color image forming mode in which a mono-color toner image on said image bearing member is electrostatically transferred onto the transfer material and a multi-color image forming mode in which plural color toner images on said image bearing member are electrostatically transferred onto the transfer material successively in a superimposed fashion, and the predetermined current value in said mono-color image forming mode differs from the predetermined current value in said multi-color image forming mode.

88. An image forming apparatus according to claim 75, wherein said transfer means is contacted with the transfer material while the image on said image bearing member is being transferred onto the transfer material.

89. An image forming apparatus according to claim 88, wherein said transfer means has a roller.

90. An image forming apparatus according to claim 75, wherein the voltage width is changed in accordance with a difference between the predetermined current value and the current value detected by said current detect means.

91. An image forming apparatus according to claim 75, wherein the voltage width used when the current value detected by said current detect means is; smaller than the predetermined current value differs from the voltage width used when the current value detected by said current detect means is larger than the predetermined current value.

92. An image forming apparatus according to claim 75, wherein the predetermined current value has a predetermined width.

93. An image forming apparatus according to claim 90 or 92, wherein, when a predetermined time period has elapsed after the voltage is applied to said voltage applied member, detection of said current detest means is started.

94. An image forming apparatus according to claim 75, further comprising:

a transfer material bearing member for bearing the transfer material, wherein said transfer means transfers the image on said image bearing member to the transfer material borne by said transfer material bearing member.

95. An image forming apparatus according to claim 94, wherein, while said transfer means transfers the image on said image bearing member to the transfer material borne by said transfer material bearing member, said control means controls output of said constant voltage power source so that the current value detected by said current detect means becomes the predetermined current value.

96. An image forming apparatus according to claim 75, wherein, while said transfer means transfers the image on said image bearing member to the transfer material, said control means controls output of said constant voltage power source so that the current value detected by said current detect means becomes the predetermined current value.

97. An image forming apparatus comprising:

an image bearing member for bearing an image;

transfer means for electrostatically transferring the image on said image bearing member to a transfer material;

a constant voltage power source;

current detect means for detecting current flowing through said transfer means when voltage is applied from said constant voltage power source to said transfer means; and control means for controlling of output of said constant voltage power source so that the current value detected by said current detect means becomes a predetermined current value, by changing the voltage applied to said transfer means every certain voltage width;

wherein the voltage width is variable with a difference between the predetermined current value and the current value detected by said current detect means.

98. An image forming apparatus according to claim 97, wherein the predetermined current value is variable with a length of the transfer material in a direction perpendicular to a transfer material shifting direction.

99. An image forming apparatus according to claim 98, further comprising a transfer material detect means for detecting the length of the transfer material in the direction perpendicular to the transfer material shifting direction, and wherein the predetermined current value can be varied on the basis of a detected result from said transfer material detect means.

100. An image forming apparatus according to claim 97, wherein, after the image on said image bearing member is transferred to a first surface of the transfer material, the image on said image bearing member can be transferred to a second surface of the transfer material opposite to the first surface, the predetermined current value being variable on the basis of the first or second surface of the transfer material to which the image on said image bearing member is transferred by said transfer means.

101. An image forming apparatus according to claim 100, further comprising judge means for judging whether a surface of the transfer material to which the image on said image bearing member is transferred by said transfer means is the first surface or the second surface, and wherein the predetermined current value can be varied on the basis of a judged result from said judge means.

102. An image forming apparatus according to claim 97, further comprising a contact member to which voltage is applied while contacting with the transfer material to pinch the transfer material before the image on said image bearing member is transferred to the transfer material by said transfer means, and wherein the predetermined current value varies on the basis of a value of current flowing through said contact member when the voltage is applied to said contact member.

103. An image forming apparatus according to claim 102, wherein said contact member has a pair of rollers.

104. An image forming apparatus according to claim 97, wherein said image bearing member is rotatable, and the predetermined current value varies on the basis of a rotational speed of said image bearing member.

105. An image forming apparatus according to claim 104, wherein the rotational speed of said image bearing member is switchable between a first speed and a second speed slower than said first speed.

106. An image forming apparatus according to claim 105, wherein, when the transfer material is a resin sheet, the rotational speed of said image bearing member is switched to the second speed.

107. An image forming apparatus according to claim 105, wherein, when a weight of the transfer material is 105 $g/m^2$ or more, the rotational speed of said image bearing member is switched to the second speed.

108. An image forming apparatus according to one of claims 105 to 107, further comprising a rotatable fixing means for fixing the image transferred to the transfer material by said transfer means, and wherein a rotational speed of said fixing means can be switched between said first speed and said second speed.

109. An image forming apparatus according to claim 97, wherein the image forming apparatus can be switched between a mono-color image forming mode in which a mono-color toner image on said image bearing member is electrostatically transferred onto the transfer material and a multi-color image forming mode in which plural color toner images on said image bearing member are electrostatically transferred onto the transfer material successively in a superimposed fashion, and the predetermined current value in said mono-color image forming mode differs from the predetermined current value in said multi-color image forming mode.

110. An image forming apparatus according to claim 97, wherein said transfer means is contacted with the transfer material while the image on said image bearing member is being transferred onto the transfer material.

111. An image forming apparatus according to claim 110, wherein said transfer means has a roller.

112. An image forming apparatus according to claim 97, wherein the voltage width used when the current value detected by said current detect means is smaller than the predetermined current value differs from the voltage width used when the current value detected by said current detect means is larger than the predetermined current value.

113. An image forming apparatus according to claim 97, wherein the predetermined current value has a predetermined width.

114. An image forming apparatus according to claim 97 or 113, wherein, when a predetermined time period is elapsed after the voltage is applied to said voltage applied member, detection of said current detect means is started.

115. An image forming apparatus according to claim 97, further comprising:

a transfer material bearing member for bearing the transfer material, wherein said transfer means transfers the image on said image bearing member to the transfer material borne by said transfer material bearing member.

116. An image forming apparatus according to claim 115, wherein, while said transfer means transfers tale image on said transfer material bearing member, said control means controls output of said constant voltage power source so that the current value detected by said current detect means becomes the predetermined current value.

117. An image forming apparatus according to claim 97, wherein, while said transfer means transfers the image on said image bearing member to the transfer material, said control means controls output of said constant voltage power source so that the current value detected by said current detect means becomes the predetermined current value.

* * * * *

UNITED STATES PATENT AND TRADEMARK OFFICE

CERTIFICATE OF CORRECTION

PATENT NO. : 5,999,760

DATED : December 7, 1999

INVENTOR(S): TAKEHIKO SUZUKI, ET AL.

It is certified that error appears in the above-identified patent and that said Letters Patent is hereby corrected as shown below:

COLUMN 4,
Line 58, "is" should read --is a--; and
Line 60, "is" should read --is a--.

COLUMN 6,
Line 24, "5fcooperates" should read --5f cooperates--; and
Line 49, "can" should read --can be--.

COLUMN 7,
Line 11, "5aonto" should read --5a onto--; and
Line 33, "current:" should read --current--.

COLUMN 8,
Line 1, "is:" should read --is--.

COLUMN 9,
Line 51, "this;" should read --this--.

COLUMN 11,
Line 47, "material." should read --material--; and
Line 57, "flowing" should read --flowing through--.

UNITED STATES PATENT AND TRADEMARK OFFICE

CERTIFICATE OF CORRECTION

PATENT NO. : 5,999,760

DATED : December 7, 1999

INVENTOR(S): TAKEHIKO SUZUKI, ET AL.

It is certified that error appears in the above-identified patent and that said Letters Patent is hereby corrected as shown below:

COLUMN 12,
Line 23, "embodiment:" should read --embodiment--; and
Line 26, "(step Si)." should read --(step S1).--.

COLUMN 15,
Line 47, "5fand" should read --5f and--.

COLUMN 16,
Line 50, "is" should read --if--; and
Line 57, "5ais" should read --5a is--.

COLUMN 19,
Line 12, "shifting" should read --conveying--; and
Line 24, "first;" should read --first--.

COLUMN 20,
Line 63, "output:" should read -- an output--.

COLUMN 21,
Line 9, "shifting" should read --conveying--.

COLUMN 23,
Line 4, "shifting" should read --conveying--; and
Line 27, "FL" should read --a--.

UNITED STATES PATENT AND TRADEMARK OFFICE

CERTIFICATE OF CORRECTION

PATENT NO. : 5,999,760

DATED : December 7, 1999

INVENTOR(S): TAKEHIKO SUZUKI, ET AL.

It is certified that error appears in the above-identified patent and that said Letters Patent is hereby corrected as shown below:

COLUMN 24,
Line 30, "is" should read --has--.

COLUMN 25,
Line 2, "shifting" should read --conveying--.

COLUMN 26,
Line 15, "is;" should read --is--;
Line 25, "detest" should read --detect--; and
Line 67, "shifting" should read --conveying--.

Signed and Sealed this

Third Day of April, 2001

*Attest:*

Nicholas P. Godici

NICHOLAS P. GODICI

*Attesting Officer*

*Acting Director of the United States Patent and Trademark Office*